US007511008B2

(12) United States Patent
Scheuing et al.

(10) Patent No.: US 7,511,008 B2
(45) **Date of Patent: *Mar. 31, 2009**

(54) POLYMER-FLUOROSURFACTANT ASSOCIATIVE COMPLEXES

(75) Inventors: David R. Scheuing, Oakland, CA (US); Mona Marie Knock, Oakland, CA (US); Michael H. Robbins, Oakland, CA (US)

(73) Assignee: The Clorox Company, Oakland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/854,885

(22) Filed: Sep. 13, 2007

(65) Prior Publication Data

US 2008/0004203 A1 Jan. 3, 2008

Related U.S. Application Data

(63) Continuation of application No. 11/105,819, filed on Apr. 24, 2005, now Pat. No. 7,288,514.

(51) Int. Cl.

| | |
|---|---|
| ***C11D 3/37*** | (2006.01) |
| ***C11D 3/24*** | (2006.01) |
| ***C11D 9/28*** | (2006.01) |
| ***C11D 13/00*** | (2006.01) |

(52) U.S. Cl. ..... 510/475; 510/191; 510/199; 510/214; 510/238; 510/239; 510/240; 510/243; 510/244; 510/245; 134/25.2; 134/39; 134/40; 134/42

(58) Field of Classification Search ..... 510/191, 510/199, 214, 238, 239, 240, 243, 244, 245, 510/475; 134/25.2, 39, 40, 42

See application file for complete search history.

(56) References Cited

U.S. PATENT DOCUMENTS

| | | | | |
|---|---|---|---|---|
| 5,654,450 | A | 8/1997 | Malik et al. | |
| 5,879,623 | A | 3/1999 | Glover et al. | |
| 6,242,046 | B1 | 6/2001 | Nakane et al. | |
| 6,383,651 | B1 | 5/2002 | Weinert et al. | |
| 6,403,760 | B1 | 6/2002 | Weinert et al. | |
| 6,465,566 | B2 | 10/2002 | Garcia et al. | |
| 6,495,636 | B2 | 12/2002 | Sugiyama et al. | |
| 6,660,828 | B2 * | 12/2003 | Thomas et al. | 528/402 |
| 6,762,162 | B1 | 7/2004 | Valpey, III et al. | |
| 7,288,514 | B2 * | 10/2007 | Scheuing et al. | 510/475 |
| 2003/0060571 | A1 | 3/2003 | Weinert et al. | |
| 2003/0109662 | A1 | 6/2003 | Medsker et al. | |
| 2003/0149186 | A1 | 8/2003 | Medsker et al. | |
| 2003/0166785 | A1 | 9/2003 | Medsker et al. | |
| 2003/0220223 | A1 | 11/2003 | Scheuing et al. | |

FOREIGN PATENT DOCUMENTS

| | | |
|---|---|---|
| WO | WO 00/29538 | 5/2000 |
| WO | WO 02/18531 | 3/2002 |

* cited by examiner

*Primary Examiner*—Brian P Mruk
(74) *Attorney, Agent, or Firm*—Alok Goel

(57) ABSTRACT

The present invention relates to associative complexes of water soluble and/or water dispersible polymers and polymeric fluorosurfactants, compositions and methods for modifying substrates to provide treated articles with surface protective properties including easier cleaning, increased stain and/or soil repellency, and increased resistance to bio-fouling and environmental contamination.

20 Claims, No Drawings

POLYMER-FLUOROSURFACTANT ASSOCIATIVE COMPLEXES

This application is a continuation application and claims priority to U.S. Ser. No. 11/105,819, filed on Apr. 24, 2005, and which is now U.S. Pat. No. 7,288,514, and is incorporated herein by reference.

BACKGROUND OF THE INVENTION

1. Field of the Invention

The present invention employs associative complexes of water soluble and/or water dispersible polymers and polymeric fluorosurfactants, compositions and methods thereof, for modifying substrates to provide treated articles with surface protective properties including easier cleaning, easier next time cleaning, increased water and/or oil repellency, increased stain and/or soil repellency, and increased resistance to bio-fouling and environmental contamination.

2. Background of the Invention

Consumers are dissatisfied with their ability to prevent water and soils, such as water spots, soap scum, toothpaste, scale, greasy soils, brake dust, grime, rust, and toilet ring, from soiling and building up on household surfaces and other exposed materials. It would be desirable to have treatment means that would easily modify or enhance the surface protective properties of a wide variety of materials to retain and/or maintain their "like new" appearance and/or clean state for longer periods of time, particularly when exposed to water, soil and the like. It would further be desirable to have a treatment means compatible with cleaning aids, so that cleaning and treatment of soiled surfaces could be done either in conjunction or simultaneously with the treatment means providing enhanced protection.

Consumers also desire cleaners and treatments that are convenient to use, provide "easier cleaning" or reduce cleaning effort, for example the need for less surface scrubbing or buffing, during the initial cleaning and/or treatment step. Even more desirable would be to have a treatment means whereby treated surfaces would exhibit an improved "next time" cleaning benefit; whereby the surface is modified to be either self-cleaning and/or more easily cleaned in a subsequent cleaning and/or treatment step. Also desirable would be a treatment means that would renew the surface protective properties of treated surfaces and articles, so that the maintenance of the surface protective properties is achieved in circumstances where an optional cleaning step or cleaning agent is not employed, or where access to the surfaces requiring cleaning and/or protection is restricted.

It has now been discovered that associative complexes of water soluble and/or water dispersible polymers and selected polymeric fluorosurfactants, either formed in situ or formulated into treatment compositions, optionally combined with cleaning agents and other adjuncts, may be employed using a variety of application and treatment methods, to modify surfaces of materials to provide treated articles exhibiting the enhanced surface protective properties described above.

Surface protecting compositions and treatment methods are well known in the art, and are employed to reduce or prevent water, oil, soils and microorganisms from adhering to the treated surfaces.

One approach is to coat surfaces with a macroscopically thick and relatively permanent stain-proofing treatment that essentially acts as a paint-like coating to seal and cover the surface. A reactive material that either chemical bonds to the surface or that internally cross links is generally employed in this approach to form a cured film. With this type of treatment, the surface generally must be cleaned and/or washed prior to application to ensure good adhesion of the film to prevent delamination or inclusion of air pockets that would lead to film degradation. The visual appearance of the treated surfaces are also significantly altered with this approach.

In another approach, a sacrificial coating may be applied to protect a surface, which upon normal attrition and wear due to environmental exposure or microbial challenge, and/or upon a subsequent cleaning operation, is substantially removed from the surface taking any adhered dirt, soils and the like with it, thereby exposing the underlying original surface. In this approach, separate protective treatment and cleaning steps must be employed, and the degree of protection generally obtained is dependent on the thickness of the sacrificial coating applied, and thus thicker films are generally preferred. This approach is less suitable for submerged surfaces or those that are frequently exposed to aqueous fluids or water.

Yet another approach particularly suited for treating surfaces in closed systems that are either intermittently or continuously exposed to a fluid system, such as in water handling and distribution systems including for example water cooling towers, toilets, bioreactors, and the like, is to add some surface active agent to the fluid system so that exposed or submerged surfaces are continuously replenished with the agent to achieve some protective properties. Generally, very high levels of such agents must be employed with this approach to ensure that an effective level is absorbed onto the target surface areas. Employing less water soluble materials with higher surface affinity, that is those exhibiting a greater tendency to absorb onto the surface, may be employed to overcome the need for high levels of the material present in the fluid system, but this limits the choice of materials and may further present problems including undesirable build-up on the surfaces and/or precipitation from solution.

An alternative approach is to deposit a protective polymer on a surface that can act to reduce the adhesion of dirt, soils and microbes. Generally, the polymers employed must have lower water solubility in order to favorably deposit onto the target surface, and/or have chemistries specifically selected with respect to the targeted surface to insure effective absorption affinity. When using less water soluble materials, which is typically preferred for system that are more effective at treating an non-selective surface, the art has employed various means to disperse or suspend these polymers in aqueous systems to make practical treatment compositions. The use of dispersion aids, such as solubilizers and emulsifiers, however, is known to reduce the effectiveness of polymeric materials from depositing onto the target surface owing to their stabilization in the solution. Thus, higher concentrations or process steps that require drying to deposit an effective level of the material may be required. Further, the presence of residual dispersion aids in the deposited polymer films may alter or lower the surface protection benefit or require a subsequent rinsing step to achieve the desired properties.

Thus, the art is in search of treatment compositions that provide stable, but thin and invisible films on treated surfaces with enhanced surface protective properties, such as water repellency and reduced adhesion of soil, biological and environmental contaminants. The art is also in need of treatment compositions that can also be employed to simultaneously clean and treat the surfaces so that separate cleaning and treatment steps are not required. In addition, with growing environmental concerns linked with the use of compounds, such as for example perfluorinated surfactants and polymers with long perfluoroalkyl chains that have preferred surface modifying agents yet possess some undesirable toxicological properties including the tendency to bio-accumulate, there is a need for materials that offer similar protective properties but which employ alternative materials that are easy to use, are effective at lower levels and which have less environmental impact.

SUMMARY OF THE INVENTION

The present invention relates generally to associative complexes of water soluble and/or water dispersible polymers and polymeric fluorosurfactants having utility for modifying household and other surfaces for the purpose of providing surface protective properties, including enhanced resistance and protection against water, oil, and biological based stains, soils and contaminants.

The present invention also relates to compositions and methods employing the associative complexes of water soluble and/or water dispersible polymers and polymeric fluorosurfactants to provide treated articles with improved surface protective properties that provide easier cleaning, increased stain and/or soil repellency, and increased resistance to bio-fouling and environmental contamination.

The present invention also relates to compositions and methods to modify the surface protective properties of articles by forming, deposition or replenishing associative complexes on the surfaces of treated articles to provide a benefit owing to the increased surface protective properties, wherein said benefits include easier cleaning, stays cleaner longer, easier next time cleaning, improved cleaning, faster cleaning, improved and/or extended protection, dirt repellency, soil repellency, microorganism repellency, reduced biofouling, reduced germ build-up, scale prevention, reduced soap scum deposition, reduced soiling, reduced cleaning time, and/or combinations thereof.

Further features and advantages of the present invention will become apparent to those of ordinary skill in the art in view of the detailed description of suitable embodiments below, when considered together with the attached claims.

DETAILED DESCRIPTION

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, suitable materials and methods are described herein.

In the application, effective amounts are generally those amounts listed as the ranges or levels of ingredients in the descriptions, which follow hereto. Unless otherwise stated, amounts listed in percentage ("%'s") are in weight percent (based on 100% active) of the total composition.

As used herein, the term "polymer" generally includes, but is not limited to, homopolymers, copolymers, such as for example, block, graft, random and alternating copolymers, terpolymers, and higher "x"mers, further including their derivatives, combinations, and blends thereof. Furthermore, unless otherwise specifically limited, the term "polymer" shall include all possible isomeric configurations of the molecule, including, but are not limited to isotactic, syndiotactic and random symmetries, and combinations thereof. Furthermore, unless otherwise specifically limited, the term "polymer" shall include all possible geometrical configurations of the molecule including, but not limited to linear, block, graft, random, alternating, branched and highly branched structures including comb, graft, starburst, dendrimers and dendrimeric structures thereof, and combinations thereof.

The terms "water soluble" and "water dispersible" as used herein, means that the polymer is soluble or dispersible in water in the inventive compositions. In general, the polymer should be soluble or dispersible at 25° C. at a concentration of 0.0001% by weight of the water solution and/or water carrier, preferably at 0.001%, more preferably at 0.01% and most preferably at 0.1%.

The term "cleaning composition", as used herein, is meant to mean and include a composition and/or formulation having at least one cleaning agent and/or cleaning aid.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes anionic, nonionic and/or amphoteric agents. The term "fluorinated", as used herein, is meant to mean a molecule containing at least one fluorine atom, In accordance with the summary of the invention above and further objects that will be mentioned and will become apparent below, one aspect of the present invention is a composition comprising: (a) an associative complex comprising: i. a water soluble and/or water dispersible polymer; ii. at least one polymeric fluorosurfactant capable of forming an associative complex with said polymer; (b) optionally, a dispersant, and; (c) optionally, a liquid carrier, wherein the associative complex molar ratio parameter, R, is greater than 0 to about 20, and wherein said associative complex is selected from the group consisting of Type I, Type II and Type III as described herein below.

In another aspect of the present invention is a method for preparing a treated article comprising the steps of: (1) providing a substrate; and (2) applying a treatment composition to the surface of said substrate that comprises: (a) an associative complex comprising: i. a water soluble and/or water dispersible polymer; ii. at least one polymeric fluorosurfactant selected from the group consisting of neutral, anionic, cationic, zwitterionic and/or ionizable fluorinated polymeric surfactants, and/or mixtures thereof, wherein said fluorosurfactant forms an associative complex with said polymer; (b) optionally, a disperant, and; (c) optionally, a liquid carrier; and (3) removing said treatment composition from said substrate to leave a treated article whereby said associative complex is deposited on said surface of said substrate; wherein the associative complex molar ratio parameter, R, is greater than 0 to about 20.0, and wherein said associative complex is selected from the group consisting of Type I, Type II and Type III, as described herein below.

In yet another aspect of the present invention is a method for preparing a treated article comprising the steps of: (1) providing a substrate; and (2) applying to at least one surface of said substrate a first treatment composition that comprises: a. a water soluble and/or water dispersible polymer, b. a liquid carrier; c. optionally, a dispersant and/or cleaning agent, and (3) removing said first treatment composition from said substrate, and; (4) applying to said surface a second treatment composition comprising: a. a polymeric fluorosurfactant, b. a second liquid carrier; and; (5) removing said second treatment composition from said substrate, whereby an associative complex comprising said polymer and said fluorosurfactant is formed on said surface of said substrate; wherein the associative complex molar ratio parameter, R, is greater than 0 to about 20.0.

The present invention is based in part on the discovery that stable associative complexes, classified as Type I, Type II, and Type III herein, employing a wide range of water soluble and/or water dispersible polymers and polymeric fluorosurfactants can be formed in situ and/or in solution, and yet exhibit strong surface adsorption properties onto a wide variety of substrates, providing the surfaces of these articles with enhanced protective properties by forming thin and invisible films upon the treated surfaces. Without being bound by theory, it is believed that the associative complexes and compositions thereof in the present invention are strongly adsorbed onto the surfaces of the treated articles to form extremely thin films and/or possibly monolayers or multilayers of deposited polymer/polymeric fluorosurfactant associative complexes that exhibit the desirable properties (hydrophobicity or water repellence, and oleophobicity or oil resistance) of low surface energy expected from a surface highly enriched in perfluorinated alkyl groups, including for example —$CF_2$— and —$CF_3$ groups. Owing to the high density of the absorbed polymeric fluorosurfactant of the associative complexes, the surface energy is lowered significantly so that the adhesion of oily soils is reduced, yielding easier subsequent cleaning of the surfaces. These adsorbed layers of the inventive associative complexes are extremely thin and invisible to the eye and are believed to be less than about <500 nanometers (nm) in average thickness, thus being particularly aesthetically suited for providing surface protection to a wide variety of materials, articles and substrates as they do not negatively affect the visual appearance of the treated surfaces. Surprisingly, although delivered from aqueous compositions, the adsorbed layers of the complexes are only very slowly removed from a surface through rinsing of the surface with water, i.e, they are very "substantive" on many surfaces. The substantivity of the associative complexes thus ensures that the polymeric fluorosurfactant is not readily rinsed off the surface with, for example, water rinses or during extended immersion of the treated surface in water.

The adsorbed layers of the associative complexes of water soluble and/or water dispersible polymers and polymeric fluorosurfactants are thermodynamically favored to form on a wide variety of surfaces, and hence are self-assembling in nature, and are further believed to be regenerable through further associative bonding with the component materials of the inventive composition. The adsorbed layers form spontaneously upon exposure of a surface to inventive compositions containing the associative complexes, and do not necessarily require a drying step to form. Hence they are useful in modifications of submersible surfaces, such as toilet bowls, surfaces continuously exposed to water, such as coolant towers and water recirculators, as well as surfaces frequently exposed to rain, moisture and the elements, such as interior surfaces like shower stalls, bathtubs and sinks, as well as the exterior surfaces of buildings, vehicles and the like.

Modification of household surfaces, as well as other hard and soft substrates by employing the inventive compositions and methods of providing adsorption of the associative complexes renders the treated articles hydrophobic as well as oleophobic, resulting in lowered adhesion and spreading of oily soils, as well as water and aqueous soils on the surfaces. Although the treated article's appearance is not visually changed owing to the inventive treatment, the result of modification of surfaces provided by the adsorbed associative complexes can be visually noted, for example by the beading of water on the surface due to an increase in the water drop contact angle. In addition, the presence of the polymeric fluorosurfactant will result in increased contact angles of liquid oils as well, which is naturally a consequence of the presence of the polymeric fluorosurfactant associated with the polymer achieving an efficacious concentration and orientation on the treated surfaces owing to the nature of the associative complex formed.

Formulations containing the associative complexes are generally compatible with, and may optionally include other adjuncts, for example cleaning agents and other performance enhancing materials that provide a secondary function, such as for example cleaning, in addition to the enhanced surface modification benefits provided by the present invention.

Use of the inventive associative complexes provides a method for greatly enhancing the surface protective properties of treated surfaces, owing to the greatly enhanced efficiency of adsorption of the polymeric fluorosurfactants onto the substrate, particularly when the ratio of the respected components of the associative complex, denoted as the associative complex molar ratio parameter, R, and described in greater detail herein below, is between 0.01 and about 20.

In addition, fouling of treated surfaces by the adhesion of bacteria and other organisms is reduced by the presence of the inventive associative complexes. Reduced bio-fouling on household surfaces, such as toilet bowls, reduces cleaning efforts and the required frequency of cleaning, and maintains a higher hygienic standard for such surfaces. Reduced bio-fouling in industrial water systems, such as cooling towers or paper/textile manufacturing systems can also be obtained by employing the compositions and methods of the present invention.

1. Water Soluble and/or Water Dispersible Polymer

A first component of the present invention is a water soluble and/or water dispersible polymer that is compatible with a liquid carrier and can be dissolved or dispersed into aqueous systems to facilitate associative bonding with a corresponding component polymeric fluorosurfactant component to provide for formation of the inventive associative complexes either in the composition, and/or in situ within an aqueous system, and/or upon the surface of a treated substrate or article when the components are suitably combined according to the methods described herein below.

Suitable water soluble and/or water dispersible polymers include all polymers that have at least one binding site capable of forming an associative complex with the polymeric fluorosurfactant. The at least one binding site includes the monomer subunits of the polymer, substituents of the monomer and/or polymer, and/or derivatives thereof that are capable of interaction via either hydrogen bonding and/or electrostatic bonding with the associated polymeric fluorosurfactant.

Suitable polymers include water soluble and/or water dispersible polymers and copolymers selected from anionic, amphoteric, cationic, neutral and/or zwitterionic polymers having at least one binding site capable of forming an associative complex with the polymeric fluorosurfactant. Suitable polymers include those water soluble and/or water dispersible polymers having at least one monomer subunit selected from anionic, cationic, neutral and/or zwitterionic subunits capable of forming an associative complex with the polymeric fluorosurfactant. Suitable polymers include those having monomer subunits selected from one or more types of monomers as described herein above, including, for example, but not limited to homopolymers having similar repeating monomer subunits and copolymers having two or more dissimilar repeating monomers.

Suitable polymers are selected from water soluble and/or water dispersible polymers that are neutral with respect to overall net electrostatic charge, being composed of neutral, amphoteric and/or zwitterionic monomer subunits, and/or equivalent molar net electronic charge combinations of anionic, cationic or ionizable monomer subunits, optionally including neutral and/or zwitterionic monomer subunits, wherein the molar charge equivalents of any oppositely charged monomers are balanced.

Suitable polymers are further selected from water soluble and/or water dispersible polyelectrolytes that are negatively or positively charged with respect to overall net electrostatic charge, being composed of anionic, cationic or ionizable monomer subunits, optionally including neutral and/or zwitterionic monomer subunits.

Amphoteric Polymers

Suitable polymers may be selected from water soluble and/or water dispersible amphoteric copolymer having at least one monomer that has a permanent anionic or cationic charge or that is capable of forming a charge on protonation, deprotonation and/or ionization. Suitable monomers are selected from (i) a monomer that is cationic or is capable of forming a cationic charge upon protonation, (ii) a monomer that is acidic and that is capable of forming an anionic charge on either deprotonation and/or ionization; (iii) a zwitterionic monomer capable of forming an electrostatic bond with either a permanently charged anionic or cationic fluorosurfactant; (iv) a monomer that has an uncharged hydrophilic group, and/or (v) a monomer that is hydrophobic, and/or combinations and/or mixtures thereof.

The level of a monomer which has a permanent ionic charge, either being an anionic or cationic charge, or that is capable of forming such charge upon protonation, deprotonation and/or ionization, may be between 3 and 100 mol %, alternatively between 10 to 60 mol % of the copolymer. The level of a second anionically charged or ionizable monomer when a cationic or cationically charged monomer is present, may be between 3 and 80 mol % and preferably 10 to 60 mol % of the copolymer. The level of other monomers, including zwitterionic monomers, hydrophilic monomers and hydrophobic monomers, when present, may be between 3 and 80 mol % and preferably 10 to 60 mol % of the copolymer. When present, the level of uncharged hydrophobic monomer is less than about 50 mol % and preferably less than 10 mol % of the copolymer. The molar ratio of the first charged monomer to the second charged monomer typically ranges from 19:1 to 1:10 and preferably ranges from 9:1 to 1:6. The molar ratio of the first charged monomer to the other zwitterionic, hydrophilic and/or hydrophobic monomer typically ranges from 4:1 to 1:4 and preferably ranges from 2:1 to 1:2.

Monomer Subunits

Suitable monomers comprising the subunits of the amphoteric polymers include permanently cationic monomers include, but are not limited to, quaternary ammonium salts of substituted acrylamide, methacrylamide, acrylate and methacrylate, such as trimethylammoniumethylmethacrylate, trimethylammonium-propymethacrylamide, trimethylammoniumethylmethacrylate, trimethylammonium-propylacrylamide, 2-vinyl N-alkyl quaternary pyridinium, 4-vinyl N-alkyl quaternary pyridinium, 4-vinylbenzyltrialkylammonium, 2-vinylpiperidinium, 4-vinylpiperidinium, 3-alkyl1-vinyl imidazolium, diallyldimethylammonium, and the ionene class of internal cationic monomers as described by D. R. Berger in Cationic Surfactants, Organic Chemistry, edited by J. M. Richmond, Marcel Dekker, New York, 1990, ISBN 0-8247-8381-6, which is incorporated herein by reference. This class includes co-poly ethylene imine, co-poly ethoxylated ethylene imine and co-poly quaternized ethoxylated ethylene imine, co-poly[(dimethylimino)trimethylene (dimethylimino)hexamethylene disalt], co-poly[(diethylimino)trimethylene(dimethylimino)trimethylene disalt], co-poly[(dimethylimino) 2-hydroxypropyl salt], co-polyquarternium-2, co-polyquarternium-17, and co-polyquarternium-18, as described in the International Cosmetic Ingredient Dictionary, 5th Edition, edited by J. A. Wenninger and G. N. McEwen, which is incorporated herein by reference. Other cationic monomers include those containing cationic sulfonium salts such as co-poly-1-[3-methyl-4-(vinyl-benzyloxy)phenyl]tetrahydrothiophenium chloride. Especially preferred monomers are mono- and di-quaternary derivatives of methacrylamide. Examples of suitable anions (counterion) for the cationic or ionizably cationic monomers, include, but are not limited to, halides such as chloride, bromide and iodide, carbonates, bicarbonates, borates, sulphates, hydrosulphates, hydrochlorides, alkylsulphates (for example comprising 1 to 6 carbon atoms), phosphates, citrates, formates, and acetates.

Examples of monomers that are cationic on protonation include, but are not limited to, acrylamide, N,N-dimethylacrylamide, N,N di-isopropylacryalmide, N-vinylimidazole, N-vinylpyrrolidone, ethyleneimine, dimethylaminohydroxypropyl diethylenetriamine, dimethylaminoethylmethacrylate, dimethylaminopropyl-methacrylamide, dimethylaminoethylacrylate, dimethylaminopropylacrylamide, 2-vinyl pyridine, 4-vinyl pyridine, 2-vinyl piperidine, 4-vinylpiperidine, vinyl amine, diallylamine, methyldiallylamine, vinyl oxazolidone; vinyl methyoxazolidone, and vinyl caprolactam.

Monomers that are cationic on protonation typically contain a positive charge over a portion of the pH range of about 2 to 11. Such suitable monomers are also presented in Water-Soluble Synthetic Polymers: Properties and Behavior, Volume II, by P. Molyneux, CRC Press, Boca Raton, 1983, ISBN 0-8493-6136. Additional monomers can be found in the International Cosmetic Ingredient Dictionary, 5th Edition, edited by J. A. Wenninger and G. N. McEwen, The Cosmetic, Toiletry, and Fragrance Association, Washington D.C., 1993, ISBN 1-882621-06-9. A third source of such monomers can be found in Encyclopedia of Polymers and Thickeners for Cosmetics, by R. Y. Lochhead and W. R. Fron, Cosmetics & Toiletries, vol. 108, May 1993, pp 95-135. All three preceding references are incorporated herein.

Examples of acidic monomers that are capable of forming an anionic charge in the composition include, but are not limited to, acrylic acid, methacrylic acid, ethacrylic acid, dimethylacrylic acid, maleic anhydride, succinic anhydride, vinylsulfonate, cyanoacrylic acid, methylenemalonic acid, vinylacetic acid, allylacetic acid, ethylidineacetic acid, propylidineacetic acid, crotonic acid, fumaric acid, itaconic acid, sorbic acid, angelic acid, cinnamic acid, styrylacrylic acid, citraconic acid, glutaconic acid, aconitic acid, phenylacrylic acid, acryloxypropionic acid, citraconic acid, vinylbenzoic acid, N-vinylsuccinamidic acid, mesaconic acid, methacroylalanine, acryloylhydroxyglycine, sulfoethyl methacrylate, sulfopropyl acrylate, and sulfoethyl acrylate. Preferred acid monomers also include styrene-sulfonic acid, 2-methacryloyloxymethane-1-sulfonic acid, 3-methacryloyl-oxypropane-1-sulfonic acid, 3-(vinyloxy)propane-1-sulfonic acid, ethylenesulfonic acid, vinyl sulfuric acid, 4-vinylphenyl sulfuric acid, ethylene phosphonic acid and vinyl phosphoric acid. Most preferred monomers include acrylic acid, methacrylic acid and maleic acid. The copolymers useful in this invention may contain the above acidic monomers and the alkali metal, alkaline earth metal, and ammonium salts thereof.

Examples of monomers having an uncharged hydrophilic group include but are not limited to vinyl alcohol, vinyl acetate, vinyl methyl ether, vinyl ethyl ether, ethylene oxide and propylene oxide. Further examples include, but are not limited to hydrophilic esters of monomers, such as hydroxyalkyl acrylate esters, alcohol ethoxylate esters, alkylpolyglycoside esters, and polyethylene glycol esters of acrylic and methacrylic acid.

Finally, examples of uncharged hydrophobic monomers include, but are not limited to, $C_1$-$C_4$ alkyl esters of acrylic acid and of methacrylic acid.

Suitable amphoteric copolymers comprising one or more of the aforementioned monomers are formed by copolymerizing the desired monomers in any suitable ratio to achieve a copolymer with the desired properties of water solubility, water dispersibility and capability of forming associative complexes with the polymeric fluorosurfactant. Conventional polymerization techniques can be employed. Illustrative techniques include, for example, solution, suspension, dispersion, or emulsion polymerization. A preferred method of preparation is by precipitation or inverse suspension polymerization of the copolymer from a polymerization media in which the monomers are dispersed in a suitable solvent. The monomers employed in preparing the copolymer are preferably water soluble and sufficiently soluble in the polymerization media to form a homogeneous solution. They readily undergo polymerization to form polymers which are water-dispersible or water-soluble. The preferred copolymers contain acrylamide, methacrylamide and substituted acrylamides and methacrylamides, acrylic and methacrylic acid and esters thereof. Suitable synthetic methods for these copolymers are described, for example, in Kirk-Othmer, Encyclopedia of Chemical Technology, Volume 1, Fourth Ed., John Wiley & Sons.

Additional examples of suitable amphoteric polymers include those disclosed in U.S. Pat. No. 6,767,410 to Aubay, et al., hereby incorporated by reference, being water soluble or water dispersible copolymers comprising, in the form of polymerized units: (a) at least one monomer compound of general formula I as disclosed therein; (b) at least one hydrophilic monomer bearing a function of acidic nature which is copolymerizable with (a) and capable of ionizing in the application medium; (c) optionally, at least one hydrophilic monomer compound containing ethylenic unsaturation and of neutral charge, bearing one or more hydrophilic groups, which is copolymerizable with (a) and (b), the a/b molar ratio being between 60/40 and 5/95.

Cationic Polymers

Suitable cationic polymers may be selected from the group consisting of natural backbone quaternary ammonium polymers, synthetic backbone quaternary ammonium polymers, natural backbone amphoteric type polymers, synthetic backbone amphoteric type polymers, and combinations thereof.

Also suitable are cationic polymers selected from natural backbone quaternary ammonium polymers including, for example, Polyquaternium-4, Polyquaternium-10, Polyquaternium-24, PG-hydroxyethylcellulose alkyldimonium chlorides, cationic guar gum, guar hydroxypropyltrimonium chloride, hydroxypropylguar hydroxypropyltrimonium chloride, and combinations thereof, synthetic backbone quaternary ammonium polymers selected from the group consisting of Polyquaternium-2, Polyquaternium-6, Polyquaternium-7, Polyquaternium-11, Polyquaternium-16, Polyquaternium-17, Polyquaternium-18, Polyquaternium-28, Polyquaternium-32, Polyquaternium-37, Polyquaternium-43, Polyquaternium-44, Polyquaternium-46, polymethacylamidopropyl trimonium chloride, acrylamidopropyl trimonium chloride/acrylamide copolymer, and combinations thereof; natural backbone amphoteric type polymers selected from the group consisting of chitosan, quaternized proteins, hydrolyzed proteins, and combinations thereof, synthetic backbone amphoteric type polymers selected from the group consisting of Polyquaternium-22, Polyquaternium-39, Polyquaternium-47, adipic acid/dimethylaminohydroxypropyl diethylenetriamine copolymer, polyvinyl-pyrrolidone/dimethylaminoethylmethacrylate copolymer, vinylcaprolactam/poly-vinylpyrrolidone/dimethylaminoethylmethacrylate copolymer, vinaylcaprolactam/polyvinylpyrrolidone/dimethylaminopropylmethacrylamide terpolymer, polyvinyl-pyrrolidone/dimethylaminopropylmethacrylamide copolymer, polyamine, and combinations thereof.

Also suitable are cationic polymers comprising (i) acrylamide monomer units, (ii) other cationic monomer units and (iii) optionally, other monomer units, examples including, but are not limited to cationically modified polyacrylamides or co-polymers thereof, and cationic copolymers of acrylamide and methyl chloride quaternary salts of dimethylaminoethyl acrylate (DMA3-MeCl), such as those supplied by BASF, Ludwigshafen, Germany, under the tradename Sedipur CL343.

Also suitable are cationic polymers that are naturally derived cationically derivatized polygalactomannans obtained from *cassia tora* and *cassia obtusifolia*, disclosed in U.S. Pat. Pub. No. 2005/0026794, to Utz, et al., which is hereby incorporated by reference.

Also suitable are cationic polymers that are synthetic backbone amphoteric type polymers and synthetic backbone cationic type polymers, including for example, but not limited to homopolymers of diallyl quaternary ammonium salt, quaternized polyvinylpyrrolidone derivatives, polyglycol polyamine condensates copolymers of vinylimidazolium trichlorides/vinylpyrrolidone, copolymers of hydroxyethyl cellulose/dimethyldiallylammonium chloride, copolymers of vinylpyrrolidone/quaternized dimethylaminoethyl methacrylate, copolymers of polyvinylpyrrolidone/alkylamino acrylate, copolymers of polyvinylpyrrolidone/alkylamino acrylate/vinylcaprolactam, copolymers of vinylpyrrolidone/methacryl-amidopropyl trimethylammonium chloride, copolymers of alkylacrylamide/acrylate/alkylaminoalkyl acrylamide/polyethylene glycol methacrylate, and copolymers of adipic acid/dimethylaminohydroxypropyl ethylenetriamine ("Cartaretin" from Sandos Co., Lt., USA).

Also suitable are cationic polymers comprising cationically ionizable or permanent cationic monomer subunits. Suitable cationic monomers are disclosed in U.S. Pat. No. 6,849,584, to Geary, et al., hereby incorporated by reference, which include aminoalkyl (meth)acrylates, (meth)aminoalkyl (meth)acrylamides; monomers comprising at least one secondary, tertiary or quaternary amine function, or a heterocyclic group containing a nitrogen atom, vinylamine or ethylenimine; diallyldialkyl ammonium salts; their mixtures, their salts, and macro monomers deriving therefrom.

Suitable polyamines, including derivatized and substituted polyamines and their derivatives, for example, polyalkyleneimines and the like, are disclosed in U.S. Pat. No. 6,559,116, to Godfroid, et al., which is hereby incorporated by reference.

Also suitable are cationic polyelectrolyte condensates, such as those disclosed in U.S. Pat. No. 6,740,633, to Nörenberg, et al., hereby incorporated by reference, including (a) cationic condensates of (i) at least one amine and (ii) a crosslinking agent from the group consisting of epihalohydrins, bishalohydrins of diols, bishalohydrins of polyalkylene glycols, bishalohydrins of polytetrahydrofurans, alkylene dihalides, alkylene trihalides, bisepoxides, trisepoxides, tetraepoxides and/or mixtures of said compounds, and/or quaternized cationic condensates of (i) and (ii). These materials are particularly noted for their resistance to precipitation in the presence of anionic adjuncts, such as anionic cleaning aids, for example anionic surfactants.

Also suitable are cationic monomers including dimethylaminoethyl (meth)acrylate, dimethylaminopropyl (meth) acrylate, ditertiobutylaminoethyl (meth)acrylate, dimethylaminomethyl (meth)acrylamide, dimethylaminopropyl (meth)acrylamide; ethylenimine, vinylamine, 2-vinylpyridine, 4-vinylpyridine; trimethylammonium ethyl(meth)acrylate chloride, trimethylammonium ethyl(meth)acrylate methyl sulphate, dimethylammonium ethyl(meth)acrylate benzyl chloride, 4-benzoylbenzyl dimethylammonium ethyl acrylate chloride, trimethyl ammonium ethyl(meth)acrylamido chloride, trimethyl ammonium propyl(meth)acrylamido chloride, vinylbenzyl trimethyl ammonium chloride, diallyldimethyl ammonium chloride.

Suitable cationic monomers further include trimethylammonium ethyl(meth)acrylate chloride, trimethylammonium ethyl(meth)acrylate methyl sulphate, dimethylammonium ethyl(meth)acrylate benzyl chloride, 4-benzoylbenzyl dimethylammonium ethyl acrylate chloride, trimethyl ammonium ethyl(meth)acrylamido chloride, trimethyl ammonium propyl(meth)acrylamido chloride, and vinylbenzyl trimethyl ammonium chloride.

Cationic polymers include those that may have antimicrobial, biocidal, antifungal, antiviral and/or other germicidal properties, such as for example, polyquaternium polymers described herein above, and polymers with cationic monomers based on quaternary ammonium chemistry. Further examples include, but are not limited to poly(hexamethylene biguanide), derivatives and salts thereof.

Also suitable are cationic monomers comprising quaternary ammonium groups of the general formula $—NR_3^+X$, wherein R, which is identical or different, represents a hydrogen atom, an alkyl group comprising 1 to 10 carbon atoms, or a benzyl group, optionally carrying a hydroxyl group, and wherein X denotes any suitable anion (counter-ion).

Further, examples of suitable anions (counter-ion) for the cationic or ionizably cationic polymers and/or their monomer subunits, include, but are not limited to, halides such as chloride, bromide and iodide, carbonates, bicarbonates, borates, sulphates, hydrosulphates, hydrochlorides, alkylsulphates (for example comprising 1 to 6 carbon atoms), phosphates, citrates, formates, and acetates.

Anionic Polymers

Suitable anionic polymers include those that have a permanent anionic charge or are ionizable in aqueous solution to form an anionic charge, and may further include copolymers with mixed monomer types wherein one or more monomers are anionic or ionizable monomer subunits.

Examples of acidic monomers that are capable of forming an anionic charge in the inventive compositions include, but are not limited to, acrylic acid, methacrylic acid, ethacrylic acid, dimethylacrylic acid, maleic anhydride, succinic anhydride, vinylsulfonate, cyanoacrylic acid, methylenemalonic acid, vinylacetic acid, allylacetic acid, ethylidineacetic acid, propylidineacetic acid, crotonic acid, fumaric acid, itaconic acid, sorbic acid, angelic acid, cinnamic acid, styrylacrylic acid, citraconic acid, glutaconic acid, aconitic acid, phenylacrylic acid, acryloxypropionic acid, citraconic acid, vinylbenzoic acid, N-vinylsuccinamidic acid, mesaconic acid, methacroylalanine, acryloylhydroxyglycine, sulfoethyl methacrylate, sulfopropyl acrylate, and sulfoethyl acrylate. Suitable acid monomers further include styrenesulfonic acid, 2-methacryloyloxymethane-1-sulfonic acid, 3-methacryloyloxy-propane-1-sulfonic acid, 3-(vinyloxy)propane-1-sulfonic acid, ethylenesulfonic acid, vinyl sulfuric acid, 4-vinylphenyl sulfuric acid, ethylene phosphonic acid and vinyl phosphoric acid, and additionally include acrylic acid, methacrylic acid and maleic acid.

The anionic polymers useful in this invention may contain the above acidic monomers and the alkali metal, alkaline earth metal, and ammonium salts (counter ions) thereof.

Polycarboxylates

Also suitable are polycarboxylates which contain amounts of non-ionizable monomers, such as ethylene and other simple olefins, styrene, alpha-methylstyrene, methyl, ethyl and C3 to C8 alkyl acrylates and methacrylates, isobornyl methacrylate, acrylamide, hydroxyethyl acrylate and methacrylate, hydroxypropyl acrylate and methacrylate, N-vinyl pyrrolidone, butadiene, isoprene, vinyl halides such as vinyl chloride and vinylidine chloride, alkyl maleates, alkyl fumarates. Other suitable anionic polymers include other polycarboxylates, such as homopolymers and copolymers of monomeric units selected from the group consisting of unsaturated carboxylic acids such as acrylic acid, methacrylic acid, polycarboxylic acids, sulfonic acids, phosphonic acids and mixtures thereof. Copolymerization of the above monomeric units among them or with other co-monomers such as maleic anhydride, ethylene or propylene are also suitable.

Polystyrenesulfonates

Other suitable anionic polymers are polystyrenesulfonates such as Flexan 130 and Versa TL501 from National Starch and Chemical. Polystyrene-sulfonates are also useful as copolymers, for example Versa TL-4 also from National Starch and Chemical.

Acrylate Polymers

Other suitable anionic polymers include acrylic emulsion polymers traditionally used as floor polish coatings. These are generally copolymers of one or more acidic monomers, such as acrylic acid, methacrylic acid or maleic anhydride, with at least one other ethylenically unsaturated monomer selected from a group consisting of ethylene and other simple olefins, styrene, alpha-methylstyrene, methyl, ethyl and C 3 to C 8 alkyl acrylates and methacrylates, isobornyl methacrylate, acrylamide, hydroxyethyl acrylate and methacrylate, hydroxypropyl acrylate and methacrylate, N-vinyl pyrrolidone, butadiene, isoprene, vinyl halides such as vinyl chloride and vinylidine chloride, alkyl maleates, alkyl fumarates, fumaric acid, maleic acid, itaconic acid, and the like. These polymers may include minor amounts of other functional monomers, such as acetoacetoxy methacrylate or other acetoacetate monomers and divinyl or polyvinyl monomers, such as glycol polyacrylates, allyl methacrylate, divinyl benzene and the like.

Suitable anionic polymers may have an acid number from about 75 to about 500,000 and a number average molecular weight of about 500 to about 20,000,000. These polymers may also be crosslinked with metal ions or modified for crosslinking with silane functionality as described, for example, in U.S. Pat. No. 5,428,107. Examples of such acrylic emulsion polymers include those available under the Rhoplex tradename from Rohm & Haas, such as Rhoplex AC-33, Rhoplex B-924, and Rhoplex MC-76. There are also polymers from National Starch and Chemical, such as Amaze, Flexan and Balance CR, Balance 47 and Balance 055. Other preferred polymers are Carboset GA 233, EX561 and 2123, all by B. F. Goodrich. Other suitable polymers are copolymers of acrylic and/or methacrylic acid with acrylate and methacrylate esters. For example, a copolymer of 51% methyl methacrylate, 31% butyl acrylate, and 18% acrylic acid is available from Rohm & Haas as Emulsion Polymer E-1250. Additionally, there are acrylates from Rohm and Haas, namely, Acusol, such as Acusol 445, and the like. See also Keyes et al., U.S. Pat. No. 4,606,842, incorporated herein by reference.

Other Polymers

Polyvinylpyrrolidones

Suitable neutral polymers, which include those polymers that are essentially uncharged at neutral aqueous solution pH, include vinylpyrrolidone homopolymers and copolymers. Suitable vinylpyrrolidone homopolymers have an average molecular weight of from 1,000 to 100,000,000. Suitable vinyl pyrrolidone homopolymers are commercially available from ISP Corporation, Wayne, N.J. under the product names PVP K-15 (average molecular weight of 8,000), PVP K30 (average molecular weight of 38,000), PVP K-60 (average molecular weight of 216,000), PVP K-90 (average molecular weight of 630,000), and PVP K-120 (average molecular weight of 2,900,000). Suitable copolymers of vinylpyrrolidone include copolymers of N-vinylpyrrolidone with one or more alkylenically unsaturated monomers. Suitable alkylenically unsaturated monomers include unsaturated dicarboxylic acids such as maleic acid, chloromaleic acid, fumaric acid, itaconic acid, citraconic acid, phenylmaleic acid, aconitic acid, acrylic acid, methacrylic acid, N-vinylimidazole, vinylcaprolactam, butene, hexadecene, and vinyl acetate. Any of the esters and amides of the unsaturated acids may be employed, for example, methyl acrylate, ethylacrylate, acrylamide, methacrylamide, dimethylaminoethylmethacrylate, dimethylamino-propylmethacrylamide, trimethylammoniumethylmethacrylate, and trimethyl-ammoniumpropylmethacrylamide. Other suitable alkylenically unsaturated monomers include aromatic monomers such as styrene, sulphonated styrene, alpha-methylstyrene, vinyltoluene, t-butylstyrene and others. Copolymers of vinyl-pyrrolidone with vinyl acetate are commercially available under the trade name PVP/VA from ISP Corporation. Copolymers of vinylpyrrolidone with alpha-olefins are available, for example, as P-904 from ISP Corporation. Copolymers of vinylpyrrolidone with styrene are available, for example, as Polectron 430 from ISP Corporation.

Also suitable are cationically modified forms of this polymer class, including copolymers of vinylpyrrolidone with dimethylaminoethylmethacrylate, which are available, for example, as Copolymer 958 from ISP Corporation. Copolymers of vinylpyrrolidone with trimethylammoniumethylmethacrylate are available, for example, as Gafquat 734 from ISP Corporation. Copolymers of vinylpyrrolidone with trimethyl-ammonium-propylmethacrylamide are available, for example, as Gafquat HS-100 from ISP Corporation.

Also suitable are anionically modified forms of this polymer class including copolymers of vinylpyrrolidone with acrylic acid, which are available, for example, as Polymer ACP 1005 (25% vinylpyrrolidone/75% acrylic acid) from ISP Corporation.

Polymethylvinyl Ethers

Other suitable polymers include methylvinylether homopolymers and copolymers. Preferred copolymers are those with maleic anhydride. These copolymers can be hydrolyzed to the diacid or derivatized as the monoalkyl ester. For example, the n-butyl ester is available as Gantrez ES-425 from ISP Corporation.

Polyvinyl Alcohols

Other suitable polymers include polyvinyl alcohols. Preferably, polyvinyl alcohols which are at least 80.0%, preferably 88-99.9%, and most preferably 99.0-99.8% hydrolyzed are used. For example, the polyvinyl alcohol, Elvanol 71-30 is available from E. I. DuPont de Nemours and Company, Wilmington, Del.

Polyethylene Glycols

Other suitable polymers include polyalkylene glycols, for example the polyethylene glycols, such as disclosed in Baker et al., U.S. Pat. No. 4,690,779, incorporated herein by reference.

2. Polymeric Fluorosurfactant

A second component of the present invention is a polymeric fluorosurfactant that is compatible with a liquid carrier and can be dissolved or dispersed into aqueous systems to facilitate association with the water soluble and/or water dispersible polymer component to provide for formation of the inventive associative complexes either in the composition, and/or in situ within an aqueous system, and/or upon the surface of a treated substrate or article when the components are suitably combined according to the methods of application of the present invention described herein below.

Suitable polymeric fluorosurfactants are selected from the group consisting of neutral, anionic, cationic, zwitterionic and/or ionizable partially fluorinated polymeric surfactants, and/or mixtures thereof, wherein said fluorosurfactant is capable of forming an associative complex with the polymer component of the present invention. Partially fluorinated polymeric surfactants generally include those materials that are not fully perfluorinated, i.e. that contain non-fluorinated carbon centers and/or non-fluorinated alkyl groups. Without being bound by theory, it is believed that the presence of non-fluorinated alkyl groups favor the formation of strong associative complexes between the polymeric surfactants and the water soluble and/or water dispersible polymers. It is found that by employing partially fluorinated polymeric surfactants, surface modification, water and oil repellency and biofouling properties of the associative complexes formed are surprisingly efficient despite the use of polymeric surfactants having only low degrees of perfluorinated alkyl substituents. Generally, polymeric surfactants having partially fluorinated alkyl substituents of from 1 to 20 carbon atoms are suitable for use in the associative complexes of the present invention.

Also suitable are those partially fluorinated materials having perfluorinated alkyl substituents from 1 to 7 and also from 1 to 4 carbon atoms.

Examples of suitable polymeric fluorosurfactants include, but are not limited to, those materials corresponding to the general structures I-IV below:

I

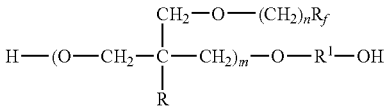

II

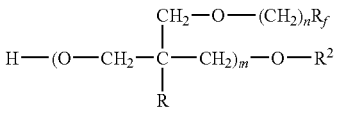

III

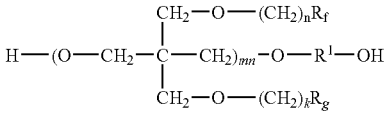

IV

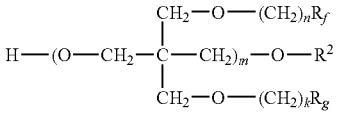

wherein and m>1 to about 100, n=1 to about 50, k=1 to about 50 including n=k, wherein $R_f$ and $R_g$ are independently selected from perfluorinated alkyl radical, perfluorinated aryl radical, partially fluorinated alkyl radical, partially fluorinated aryl radical, derivatives thereof, and/or combinations thereof, and R is hydrogen, or an alkyl comprising from 1 to 6 carbon atoms, $R^1$ is an alkyl having from 1 to 18 carbon atoms, $R^2$ is an alkyl having from 1 to 40 carbon atoms, wherein R, $R^1$ and/or $R^2$ may independently be alkyl and/or alkylene moieties derivatized with radicals selected from carboxylic, ester, amine, amide, aminoamide, siloxane, silyl, alkylsiloxane, perfluoroalkyl and/or combinations thereof. Also suitable are derivatives of any one of the polymeric fluorosurfactants represented by formula I-IV herein above, in which derivation at any one or more alkyl positions is independently performed by covalent attachment of polar anionic groups, including for example, but not limited to carboxylate, alkyl esters, sulfate, sulfonate, phosphate, nitrate, and the like; covalent attachment of cationic groups, including for example, but not limited to ammonium, quaternary ammonium, quaternary alkyl ammonium, and the like; covalent attachment of polar nonionic groups, including for example, but not limited to poly(alkylene oxide), such as poly(ethylene oxide) and/or poly(propylene oxide), polyether copolymers, carbonyl, nitrite, thiol, and/or cyano groups, and combinations thereof.

Suitable examples of the polymeric fluorosurfactants useful in the present invention include those derived from polymerizing appropriate fluorinated oxetane monomers to obtain fluorosurfactants corresponding to any one of structures I-IV wherein $R_f$ and $R_g$ are selected from $—CF_3$, $—CF_2CF_3$, $—(CF_2)_pCF_3$, $—R'CF_3$, $—R'(CF3)_p$, $—R''(CF_3)_q$, wherein R' is a $C_1$ to $C_{20}$ linear or branched, alkyl or alkylene moiety, optionally substituted with and/or terminated with at least one $—CF_3$ group, R" is radical comprising a benzyl, phenyl and/or aryl group with q degrees of $—CF_3$ substitution, wherein p is 1 to about 10, and q is between 1 and 5. An example of commercially available polymeric fluorosurfactants include those corresponding to structures I-IV in which $R_f$ and $R_g$ correspond to $—(CF_2)_pCF_3$ with p=3, equivalent to $—CF_2—CF_2—CF_2—CF_3$ ($—C_4F_9$), which is recognized as having less environmental bioaccumulation concerns than longer chain perfluoro groups. There are other polymeric fluorosurfactants and derivatives suitable for use in the present invention described in U.S. Pat. No., 6,403,760 to Weinert, et al., U.S. Pat. Pub. No. 2003/0060571 to Weinert, et al., U.S. Pat. Pub. No. 2003/0149186 to Medsker et al., U.S. Pat. No. 6,660,828 to Thomas, et al., and U.S. Pat. No. 6,403,760 to Weinert et al., which are all hereby incorporated by reference.

Other suitable examples of the polymeric fluorosurfactants useful in the present invention include those derived from structures I through IV by covalent attachment of polar anionic groups such as carboxylate, sulfate, sulfonate, phosphate, and nitrate. Useful counterions for these groups include $Li^+$, $Na^+$, $K^+$, $Cs^+$, and ammonium or alkyl ammonium groups. Also suitable are polymer derivatized polymeric fluorosurfactants described in U.S. Pat. Pub. No. 2003/0166785 to Medsker et al., and U.S. Pat. No. 6,383,651 to Weinert, et al., both of which are hereby incorporated by reference. Also suitable are copolymers with perfluorinated oxetane compounds formed via radical polymerization and/or cationic polymerizations such as those described in U.S. Pat. No. 6,495,636 to Sugiyama, et al., which is hereby incorporated by reference.

In addition, structure V is an example of a useful anionic polymeric fluorosurfactant that may be employed in the present invention.

V

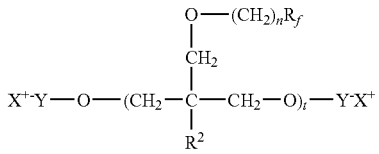

wherein t typically ranges from 6 to about 8, but may be any value from 1 to about 100, n=1 to about 50, $R_f$ is selected from $—CF_3$, $—CF_2CF_3$, $—(CF_2)_pCF_3$, $—R'CF_3$, $—R'(CF3)_p$, $—R''(CF_3)_q$, wherein R' is a $C_1$ to $C_{20}$ linear or branched, alkyl or alkylene moiety, optionally substituted with and/or terminated with at least one $—CF_3$ group, R" is radical comprising a benzyl, phenyl and/or aryl group with q degrees of $—CF_3$ substitution, wherein p is 1 to about 10, and q is between 1 and 5, $R^2$ is an alkyl having from 1 to 40 carbon atoms, further including alkyl and/or alkylene moieties derivatized with radicals selected from carboxylic, ester, amine, amide, aminoamide, siloxane, silyl, alkylsiloxane, perfluoroalkyl and/or combinations thereof, $X^+$ is any suitable cationic counterion as described herein, and wherein $Y^-$ is an anionic moiety selected from carbonate, borate, sulfate, sulfonate, phosphate, phosphonate, nitrate and/or combinations thereof An example of a commercially available material corresponding to structure V is one wherein n=2, $R_f$=$—CF_3$, $R^2$=$—CH_3$ and Y=$SO_3^-$, thus being a sulfate moiety and $X^-$ is $Na^+$ or $NH_4^+$.

Other suitable examples of polymeric fluorosurfactants useful in the present invention include those containing covalently bonded cationic groups such as ammonium or quaternary ammonium or phosphonium. The anionic counterions associated with these groups can include fluoride, chloride, bromide, iodide, and tetrafluoroborate ($BF_4^-$).

Other polymeric fluorosurfactants useful in the present invention include those containing covalently bonded polar nonionic groups. These nonionic groups may be selected from various polyethers having from 1 to about 100 repeat units (n), and include, but are not limited to groups such as —O—$(CH_2CH_2O)_n$—H (poly(ethylene oxide)), —O—$CH_2(CH_3)CH_2O)n$—H (poly(propylene oxide)), polyether copolymers, carbonyl, nitrile, thiol, and/or cyano groups, and combinations thereof.

Still other polymeric fluorosurfactants useful in the present invention include those containing covalently bonded polar zwitterionic groups, forming an amphoteric type polymeric fluorosurfactant.

In the polymeric fluorosurfactants of the present invention, the polar group or groups may be covalently bonded to the ends of the polymeric fluorosurfactant. Also suitable, however, are polymeric fluorosurfactants in which the polar groups, or additional non-terminally bonded polar groups, are also covalently bonded at other positions on the polymeric fluorosurfactant molecule. Any variety of synthetic schemes may be used to attach the polar groups to polymeric fluorosurfactants suitable for use, including addition through polymerization with initiators or chain transfer agents, grafting reactions, addition reactions such as condensation of a hydroxyl group with an isocyanate that contains a polar group to be added, substitution or metathesis, or esterification of a hydroxyl group with sulfuric acid. Such reactions are well known in the art, and example applications to the synthesis of useful polymeric fluorosurfactants can be found in U.S. Pat. No. 2003/0109662 to Medsker, et al., and U.S. Pat. No. 6,660,828 to Thomas, both reference above.

Associative Complex

The associative complexes of the present invention may comprise a variety of different classes of associative complexes that can be formed depending on the specific natures of the water soluble and/or water dispersible polymer and the corresponding polymeric fluorosurfactant. The formation of one class (Type I) of the associative complexes is driven by electrostatic interactions between oppositely charged and/or polarizable constituents on the correspondingly paired components. For example, electrostatic interactions will predominantly drive associative complex formation between a polymeric fluorosurfactant with anionic polar groups such as sulfate or phosphate groups and a corresponding water soluble polymer with cationic groups, such as for example, but not limited to, a cationic polymer like poly(diallyl dimethylammonium chloride) (pDADMAC).

Alternatively, a Type I associative complex may be formed by combining a cationically charged polymeric fluorosurfactant bearing, for example, one or more alkyl ammonium groups, with an anionic water soluble polymer, for example, but not limited to an anionic polymer such as the sodium salt of poly(acrylic acid) (pAA), wherein the predominant bonding forces would be electrostatic in nature due to attractions between the oppositely charged components, these being the charged groups and monomer subunits of the respective polymeric fluorosurfactant and anionic water soluble polymer.

Further, a Type I associative complex may also be formed between an anionic polymeric fluorosurfactant, such as for example, but not limited to a polymeric fluorosurfactant bearing one or more sulfate groups, combined with a water soluble or dispersible amphoteric polymer such as for example, but not limited to, a copolymer of 20 mole % acrylic acid (AA): 80 mole % DADMAC that carriers an overall positive or cationic charge providing strong electrostatic associative forces.

A second class of associative complexes between the water soluble or water dispersible polymer and the polymeric fluorosurfactant results from hydrogen bonding (Type II) between polar and/or polarizable moieties located on conformationally adaptable portions of the respective components. For example, a polymeric fluorosurfactant containing one or more hydroxyl end groups or substituents may be employed to form a Type II associative complex with a neutral, uncharged water soluble polymer such as for example, but not limited to a poly(ethyleneimine), stabilized through hydrogen bonding interactions between the corresponding oxygen of the polar hydroxyl group and polarizable primary hydrogen's present on the nitrogen groups comprising the repeating ethyleneimine backbone. Combinations of a neutral or uncharged polymer with either a charged, neutral or zwitterionic polymeric surfactant are further suitable examples of the Type II associative complexes of the present invention. Alternatively, combinations of a charged, neutral or zwitterionic polymer with a neutral or nonionic polymeric surfactant are also suitable for forming the inventive associative complexes.

A third class of associative complexes (Type III) between the water soluble and/or water dispersible polymer and the polymeric fluorosurfactant is possible by combining polymers and polymeric fluorosurfactants in which both electrostatic and hydrogen bonding interactions act to stabilize the formation of the associative complex. Representative embodiments of this class include associative complexes between charged polymeric surfactants (anionic or cationic) optionally having in addition at least one hydrogen bonding moiety available, and either a corresponding reverse charged copolymer (i.e. cationic or anionic, respectively) or amphoteric copolymer (bearing both anionic and cationic monomer functionalities) wherein the copolymer further includes at least one additional monomer capable of forming a hydrogen bond with either the charged moiety on the polymeric surfactant or its hydrogen bonding moiety.

The polymeric fluorosurfactants and the water soluble and/or dispersible polymers of the present invention will generally contain species of varying molecular weight, as is common with most polymeric materials owing to the manner in which they are polymerized, purified and extracted from the reaction media used in their production. Thus, in the detailed examples of suitable embodiments presented hereinbelow, average molecular weights or degrees of polymerization are used to describe these materials and formulations thereof.

The formation of the associative complexes of the present invention is not believed to be a strong function of the molecular weight of the water soluble and/or dispersible polymer. Thus, water soluble polymers with number average molecular weights greater than about 500 can be used and there appears to be no upper limit other than that dictated by the degree of solubility or dispersibility desired by the formulator in compositions employing the inventive associative complexes. The molecular weight of suitable water soluble and/or dispersible polymers which can be used is not limited by the formation of the associative complexes with the polymer fluorosurfactant. Selection of the molecular weight of the water soluble and/or dispersible polymer may thus be governed by other secondary attributes of the formulations, such as viscosity and rheology of the compositions employing the associative complexes or their components, and/or processability and/or handling and/or dispensing and/or application or solubility of the polymer or corresponding formulated associative complex.

One of the essential factors that governs the nature of the associative complexes formed is the effective molar ratio of the amounts of the polymeric fluorosurfactant and the water soluble and/or dispersible polymers employed. A convenient measure of this effective molar ratio can be defined as the associative complex molar ratio, or R, defined hereinbelow.

In addition to the associative complex molar ratio, other compositional factors that affect the nature of the associative complexes formed and their adsorption onto surfaces are the total concentrations of the polymeric fluorosurfactant and water-soluble and/or dispersible polymer employed, and in formulations employing an optional adjunct such as a cleaning adjunct such as a surfactant that also exhibits some surface activity, the total concentration of the optional adjunct present. These concentrations of the inventive components and any optional adjuncts can be expressed as simple weight percentages in the composition, or in the case of low values, as parts per million (ppm) weight of the component with respect to the total formulation or composition weight.

Associative Complex Molar Ratio

The associative complex molar ratio parameter, R, is defined by the molar ratio of the associating subunits of the respective water soluble and/or water dispersible polymer and the polymeric fluorosurfactant that form the associative complexes of the present invention.

In associative complexes of the present invention in which the complementary components bear oppositely charged moieties, the number of moles of the monomer units of the associating water soluble and/or water dispersible polymer that bear a charge opposite to that of the polymeric fluorosurfactant is accounted for in addition to the number of charge equivalents per monomer unit. In neutral associative complexes of the present invention, including those in which either complementary component is a charge neutral zwitterionic and/or amphoteric species under conditions of use, the associative complex molar ratio takes into account the number of moles of the monomer units and/or substituents of each component capable of associating via intermolecular hydrogen bonding.

In mixed classes of associative complexes of the present invention in which only one of the complementary components bears a net charge, associative interaction is driven primarily by the hydrogen bonding interaction and the number of moles of the monomer units and/or substituents of each component capable of forming intermolecular hydrogen bonds is considered.

The associative complex molar ratio parameter R is calculated using the following ratio:

$$R=G_p/G_f$$

wherein $G_p$ is the number of moles of associating groups contributable by the water soluble and/or water dispersible polymer and $G_f$ is the number of moles of associating groups contributable by the polymeric fluorosurfactant, wherein said molar quantities are defined as:

$$G_p=(C_p\times F_p\times Q_p)/(M_p)$$

$$G_f=(C_f\times Q_f)/(M_f)$$

wherein $C_p$ is the concentration of polymer, in grams/100 grams formulation; $F_p$ is the weight fraction of the associating monomer unit of the polymer with respect to the total polymer weight, and thus can have values between 0 to 1.0; $Q_p$ is an integer indicating the number of formal charges or interacting groups per associating monomer unit of the polymer; $M_p$ is the molecular weight of the associating monomer unit expressed in grams/mole; $C_f$ is the weight/weight concentration of the polymeric fluorosurfactant expressed in grams per 100 grams of use formulation and/or use composition; $Q_f$ is the average number of associating groups of the polymeric fluorosurfactant present in the polymeric fluorosurfactant, expressed as an integer or integer fraction; and $M_f$ is the number average molecular weight of the polymeric fluorosurfactant expressed in grams/mole.

The associative complex molar ratio, R, of the inventive compositions described herein can be readily chosen to suit the requirements for the particular application, method of treatment and treated article desired. Suitable R values are typically greater than 0.01 to about 20. From a stoichiometric relationship, when the associative complexes involve oppositely charged polymeric surfactant and polyelectrolyte components, charge neutrality may occur around R values of about 1. However, formulations in which the molar concentration of the associating monomer units of a polyelectrolyte exceeds that of the polymeric fluorosurfactant and correspondingly, values of R of greater than 1 are often desirable, i.e. not all of the associating groups on the polymer need be associated with an interacting group of the polymeric fluorosurfactant to yield acceptable performance. Without being bound by theory, it is believed that the novel associative complexes of the present invention, whether being formed between neutral components and/or oppositely charged components of the associative complex, form novel micellar phases of the associative complexes in solution and on the surfaces of the treated substrates that provide articles with the novel surface protective properties described herein. Examples of representative embodiments and materials suitable for use in preparing compositions and treated articles with associative complexes according to the present invention are presented herein below.

Composition

A composition according to the present invention may contain a (I) water soluble and/or water dispersible polymer and a (II) polymeric fluorosurfactant, or may comprise two or more partial compositions with at least one of the these components present in at least one of the separate partial compositions so that combination or use of said compositions according to the methods described herein enables formation of the associative complexes either in solution, in situ or on the surface of the treated substrate and/or articles, or provides for renewable of a previously formed associative complex present on the surface of the treated substrate or article to which any one of the compositions is applied.

Generally, combinations of the water soluble and/water dispersible polymer and corresponding polymeric surfactant of the inventive associative complexes are selected that are soluble or dispersible in a liquid carrier for ease of preparation, storage and usage. However, due to the self-associating nature of the components of the associative complexes, the components may be separately stored and applied, provided that the two components are brought into combination in a manner appropriate to treat the surface as described in the methods of the present invention herein.

In formulated compositions with both components present, a liquid carrier is employed in the role of carrier and/or solvent for the associative complexes. Thus, a suitable solvent could be employed to dissolve the associative complexes forming a treatment composition that could be used directly for application onto a substrate, for example by employing a method such as solvent casting or an aerosol or spraying means. Alternatively, a suitable solvent system could be employed, for example to formulate concentrated solutions of the associative complexes, that are then dissolved or added to an aqueous system to prepare a treatment composition or treatment system.

Liquid Carrier

The composition may optionally contain a liquid carrier for the purpose of dissolving, dispersing and/or stabilizing and/or serving as solvent for the associative complexes. Generally, formulations of the associative complexes may employ water or an aqueous solution as a liquid carrier to dissolve or suspend the associative complexes, and optionally other adjuncts including dispersants, cleaning aids and the like. However, other liquid carriers may suitably be employed depending on the application and intended method of use, including for example, but not limited to non-aqueous solvents, organic solvents, silicones, water miscible and immiscible solvents, non-water soluble solvents, ionic liquids, aerosols, propellant systems and condensed gas phases, and/or combinations thereof.

Suitable organic solvents include, but are not limited to, $C_{1-6}$ alkanols, $C_{1-6}$ diols, $C_{1-10}$ alkyl ethers of alkylene glycols, $C_{3-24}$ alkylene glycol ethers, polyalkylene glycols, short chain carboxylic acids, short chain esters, isoparafinic hydrocarbons, mineral spirits, alkylaromatics, terpenes, terpene derivatives, terpenoids, terpenoid derivatives, formaldehyde, and pyrrolidones. Alkanols include, but are not limited to, methanol, ethanol, n-propanol, isopropanol, butanol, pentanol, and hexanol, and isomers thereof Diols include, but are not limited to, methylene, ethylene, propylene and butylene glycols. Alkylene glycol ethers include, but are not limited to, ethylene glycol monopropyl ether, ethylene glycol monobutyl ether, ethylene glycol monohexyl ether, diethylene glycol monopropyl ether, diethylene glycol monobutyl ether, diethylene glycol monohexyl ether, propylene glycol methyl ether, propylene glycol ethyl ether, propylene glycol n-propyl ether, propylene glycol monobutyl ether, propylene glycol t-butyl ether, di- or tri-polypropylene glycol methyl or ethyl or propyl or butyl ether, acetate and propionate esters of glycol ethers. Short chain carboxylic acids include, but are not limited to, acetic acid, glycolic acid, lactic acid and propionic acid. Short chain esters include, but are not limited to, glycol acetate, and cyclic or linear volatile methylsiloxanes.

Water insoluble solvents such as isoparaffinic hydrocarbons, mineral spirits, alkylaromatics, terpenoids, terpenoid derivatives, terpenes, and terpenes derivatives can be employed alone or in combination, or optionally mixed with a water soluble solvent when employed.

Examples of organic solvents having a vapor pressure less than 0.1 mm Hg (20° C.) include, but are not limited to, dipropylene glycol n-propyl ether, dipropylene glycol t-butyl ether, dipropylene glycol n-butyl ether, tripropylene glycol methyl ether, tripropylene glycol n-butyl ether, diethylene glycol propyl ether, diethylene glycol butyl ether, dipropylene glycol methyl ether acetate, diethylene glycol ethyl ether acetate, and diethylene glycol butyl ether acetate (all available from ARCO Chemical Company).

Suitable propellants used for aerosol based compositions are well known in the art and can be suitably employed. Preferably, ozone compliant propellants are employed for applications involving a high percentage of propellant and/or aerosol content.

Suitable condensed gases include those gases that are liquids under moderate pressure and/or temperatures conditions, and include the short alkyl chain length hydrocarbons such as methane, propane, butane and pentane, isomers and derivatives thereof. Addition suitable condensed gases include ammonium and carbon dioxide.

Dispersant

The composition may optionally contain a dispersant. Generally, formulations of the present invention may optionally employ a non-associating or weakly-associating dispersant or suspension aid to stabilize the associative complexes in the liquid carrier to prevent precipitation and/or phase separation. In aqueous or predominantly aqueous systems, non-associating or weakly-associating surfactants may be employed in this capacity. The presence of a dispersant may also be selected solely to aid cleaning efficacy to the inventive compositions, particularly when applied to surfaces that may bear particulate and/or oily soils and residues that are desirably removed during treatment.

Suitable dispersants include water soluble surfactants and thus can also serve as cleaning agents in conjunction with the associative complexes and compositions thereof where cleaning and protection of treated surfaces are desired.

Suitable dispersants include water soluble surfactants selected from anionic, nonionic, cationic, ampholytic, amphoteric and zwitterionic surfactants, and mixtures thereof. A typical listing of anionic, nonionic, ampholytic, and zwitterionic classes, and species of these surfactants, is given in U.S. Pat. No. 3,929,678, to Laughlin and Heuring, which is hereby incorporated by reference. A list of suitable cationic surfactants is given in U.S. Pat. No. 4,259,217, to Murphy, which is hereby incorporated by reference. Where present, ampholytic, amphoteric and zwitterionic surfactants are generally used in combination with one or more anionic and/or nonionic surfactants. When employed, a dispersant or surfactant may be present at a level of from about 0% to 90%, or from about 0.001% to 50%, or from about 0.01% to 25% by weight.

The dispersant and/or cleaning agent may comprise an anionic surfactant. Essentially any anionic surfactants useful for detersive purposes can be comprised in the inventive compositions. These can include salts (including, for example, sodium, potassium, ammonium, and substituted ammonium salts such as mono-, di- and tri-ethanolamine salts) of the anionic sulfate, sulfonate, carboxylate and sarcosinate surfactants. Anionic surfactants may comprise a sulfonate or a sulfate surfactant. Anionic surfactants may comprise an alkyl sulfate, a linear or branched alkyl benzene sulfonate, or an alkyldiphenyloxide disulfonate, as described herein.

Other suitable anionic surfactants include the isethionates such as the acyl isethionates, N-acyl taurates, fatty acid amides of methyl tauride, alkyl succinates and sulfosuccinates, monoesters of sulfosuccinate (for instance, saturated and unsaturated $C_{12}$-$C_{18}$ monoesters) diesters of sulfosuccinate (for instance saturated and unsaturated $C_6$-$C_{14}$ diesters), N-acyl sarcosinates. Resin acids and hydrogenated resin acids are also suitable, such as rosin, hydrogenated rosin, and resin acids and hydrogenated resin acids present in or derived from tallow oil. Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysacchanides such as the sulfates of alkylpolyglucoside (the nonionic non-sulfated compounds being described herein). Alkyl sulfate surfactants may be selected from the linear and branched primary $C_{10}$-$C_{18}$ alkyl sulfates, the $C_{11}$-$C_{15}$ branched chain alkyl sulfates, or the $C_{12}$-$C_{14}$ linear chain alkyl sulfates.

Suitable nonionic alkyl ethoxysulfate surfactants may be selected from the group consisting of the $C_{10}$-$C_{18}$ alkyl sulfates which have been ethoxylated with from 0.5 to 20 moles of ethylene oxide per molecule. The alkyl ethoxysulfate surfactant may be a $C_{11}$-$C_{18}$, or a $C_{11}$-$C_{15}$ alkyl sulfate which has been ethoxylated with from 0.5 to 7, or from 1 to 5, moles of ethylene oxide per molecule. One aspect of the invention employs mixtures of the alkyl sulfate and/or sulfonate and alkyl ethoxysulfate surfactants. Such mixtures have been disclosed in PCT Patent Application No. WO 93/18124, which is hereby incorporated by reference.

Anionic sulfonate surfactants suitable for use herein include the salts of $C_5$-$C_{20}$ linear alkylbenzene sulfonates, alkyl ester sulfonates, $C_6$-$C_{22}$ primary or secondary alkane sulfonates, $C_6$-$C_{24}$ olefin sulfonates, sulfonated polycarboxylic acids, alkyl glycerol sulfonates, fatty acyl glycerol sulfonates, fatty oleyl glycerol sulfonates, and any mixtures thereof. Suitable anionic carboxylate surfactants include the alkyl ethoxy carboxylates, the alkyl polyethoxy polycarboxylate surfactants and the soaps ('alkyl carboxyls'), especially certain secondary soaps as described herein. Suitable alkyl ethoxy carboxylates include those with the formula $RO(CH_2CH_20)xCH_2COO$—M+ wherein R is a $C_6$ to $C_{18}$ alkyl group, x ranges from 0 to 10, and the ethoxylate distribution is such that, on a weight basis, the amount of material where x is 0 is less than 20% and M is a cation. Suitable alkyl polyethoxypolycarboxylate surfactants include those having the formula RO—($CHR^1$—$CHR^2$-0)-$R^3$ wherein R is a $C_6$ to $C_{18}$ alkyl group, x is from 1 to 25, $R^1$ and $R^2$ are selected from the group consisting of hydrogen, methyl acid radical, succinic acid radical, hydroxysuccinic acid radical, and mixtures thereof, and $R^3$ is selected from the group consisting of hydrogen, substituted or unsubstituted hydrocarbon having between 1 and 8 carbon atoms, and mixtures thereof.

Suitable soap surfactants include the secondary soap surfactants, which contain a carboxyl unit connected to a secondary carbon. Suitable secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid. Certain soaps may also be included as suds suppressors.

Other suitable anionic surfactants are the alkali metal sarcosinates of formula R—CON($R^1$CH)COOM, wherein R is a $C_5$-$C_{17}$ linear or branched alkyl or alkenyl group, $R^1$ is a $C_1$-$C_4$ alkyl group and M is an alkali metal ion. Examples are the myristyl and oleoyl methyl sarcosinates in the form of their sodium salts.

Essentially any alkoxylated nonionic surfactants are suitable herein, for instance, ethoxylated and propoxylated nonionic surfactants. Alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

The condensation products of aliphatic alcohols with from 1 to 25 moles of alkylene oxide, particularly ethylene oxide and/or propylene oxide, are suitable for use herein. The alkyl chain of the aliphatic alcohol can either be straight or branched, primary or secondary, and generally contains from 6 to 22 carbon atoms. Also suitable are the condensation products of alcohols having an alkyl group containing from 8 to 20 carbon atoms with from 2 to 10 moles of ethylene oxide per mole of alcohol.

Polyhydroxy fatty acid amides suitable for use herein are those having the structural formula $R^2CONR^1Z$ wherein: $R^1$ is H, $C_1$-$C_4$ hydrocarbyl, 2-hydroxyethyl, 2-hydroxypropyl, ethoxy, propoxy, or a mixture thereof, for instance, $C_1$-$C_4$ alkyl, or $C_1$ or $C_2$ alkyl; and $R^2$ is a $C_5$-$C_{31}$ hydrocarbyl, for instance, straight-chain $C_5$-$C_{19}$ alkyl or alkenyl, or straight-chain $C_9$-$C_{17}$ alkyl or alkenyl, or straight-chain $C_{11}$-$C_{17}$ alkyl or alkenyl, or mixture thereof-, and Z is a polyhydroxyhydrocarbyl having a linear hydrocarbyl chain with at least 3 hydroxyls directly connected to the chain, or an alkoxylated derivative (for example, ethoxylated or propoxylated) thereof. Z may be derived from a reducing sugar in a reductive amination reaction, for example, Z is a glycityl.

Suitable fatty acid amide surfactants include those having the formula: $R^1CON(R^2)_2$ wherein $R^1$ is an alkyl group containing from 7 to 21, or from 9 to 17 carbon atoms and each $R^2$ is selected from the group consisting of hydrogen, $C_1$-$C_4$ alkyl, $C_1$-$C_4$ hydroxyalkyl, and —$(C_2H_4O)_xH$, where x is in the range of from 1 to 3.

Suitable alkylpolysaccharides for use herein are disclosed in U.S. Pat. No. 4,565,647 to Llenado, hereby incorporated by reference, having a hydrophobic group containing from 6 to 30 carbon atoms and a polysaccharide, e.g., a polyglycoside, hydrophilic group containing from 1.3 to 10 saccharide units. Alkylpolyglycosides may have the formula: $R^2O(C_nH2_nO)_t$ $(glycosyl)_x$ wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl may be derived from glucose.

Suitable amphoteric surfactants for use herein include the amine oxide surfactants and the alkyl amphocarboxylic acids. Suitable amine oxides include those compounds having the formula $R^3(OR^4)XNO(R^5)_2$ wherein $R^3$ is selected from an alkyl, hydroxyalkyl, acylamidopropyl and alkylphenyl group, or mixtures thereof, containing from 8 to 26 carbon atoms; $R^4$ is an alkylene or hydroxyalkylene group containing from 2 to 3 carbon atoms, or mixtures thereof, x is from 0 to 5, preferably from 0 to 3; and each $R^5$ is an alkyl or hydroxyalkyl group containing from 1 to 3, or a polyethylene oxide group containing from 1 to 3 ethylene oxide groups. Suitable amine oxides are $C_{10}$-$C_{18}$ alkyl dimethylamine oxide, and $C_{10}$-$C_{18}$ acylamido alkyl dimethylamine oxide. A suitable example of an alkyl amphodicarboxylic acid is Miranol™ C2M Conc. manufactured by Miranol, Inc., Dayton, N.J.

Zwitterionic surfactants can also be incorporated into the cleaning compositions. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Suitable betaines are those compounds having the formula $R(R^1)_2N^+R^2COO^-$ wherein R is a $C_6$-$C_{18}$ hydrocarbyl. group, each $R^1$ is typically $C_1$-$C_3$ alkyl, and $R^2$ is a $C_1$-$C_5$ hydrocarbyl group. Suitable betaines are $C_{12}$-$C_{18}$ dimethylammonio hexanoate and the $C_{10}$-$C_{18}$ acylamidopropane (or ethane) dimethyl (or diethyl) betaines. Other derivatized betaine surfactants are also suitable for use herein.

Suitable cationic surfactants to be used herein include the quaternary ammonium surfactants. The quaternary ammonium surfactant may be a mono $C_6$-$C_{16}$, or a $C_6$-$C_{10}$ N-alkyl or alkenyl ammonium surfactant wherein the remaining N positions are substituted by methyl, hydroxyethyl or hydroxypropyl groups. Suitable are also the mono-alkoxylated and bis-alkoxylated amine surfactants.

Another suitable group of cationic surfactants, which can be used in the inventive compositions, are cationic ester surfactants. The cationic ester surfactant is a compound having surfactant properties comprising at least one ester (i.e.

—COO—) linkage and at least one cationically charged group. Suitable cationic ester surfactants, including choline ester surfactants, have for example been disclosed in U.S. Pat. Nos. 4,228,042, 4,239,660 and 4,260,529, which are all hereby incorporated by reference. The ester linkage and cationically charged group may be separated from each other in the surfactant molecule by a spacer group consisting of a chain comprising at least three atoms (i.e. of three atoms chain length), or from three to eight atoms, or from three to five atoms, or three atoms. The atoms forming the spacer group chain are selected from the group consisting, of carbon, nitrogen and oxygen atoms and any mixtures thereof, with the proviso that any nitrogen or oxygen atom in said chain connects only with carbon atoms in the chain. Thus spacer groups having, for example, —O—O— (i.e. peroxide), —N—N—, and —N—O— linkages are excluded, whilst spacer groups having, for example —$CH_2$—O—, $CH_2$— and —$CH_2$—NH—$CH_2$— linkages are included. The spacer group chain may comprise only carbon atoms, or the chain is a hydrocarbyl chain.

The inventive compositions may also employ cationic mono-alkoxylated amine surfactants, for instance, of the general formula: $R^1R^2R^3N^-A_pR^4X^-$ wherein $R^1$ is an alkyl or alkenyl moiety containing from about 6 to about 18 carbon atoms, or from 6 to about 16 carbon atoms, or from about 6 to about 14 carbon atoms; $R^2$ and $R^3$ are each independently alkyl groups containing from one to about three carbon atoms, for instance, methyl, for instance, both $R^2$ and $R^3$ are methyl groups; $R^4$ is selected from hydrogen, methyl and ethyl; $X^-$ is an anion such as chloride, bromide, methylsulfate, sulfate, or the like, to provide electrical neutrality; A is a alkoxy group, especially a ethoxy, propoxy or butoxy group; and p is from 0 to about 30, or from 2 to about 15, or from 2 to about 8. The $A_pR^4$ group in the formula may have p=1 and is a hydroxyalkyl group, having no greater than 6 carbon atoms whereby the —OH group is separated from the quaternary ammonium nitrogen atom by no more than 3 carbon atoms. Suitable $A_pR^4$ groups are —$CH_2CH_2$-0H, —$CH_2CH_2CH_2$-0H, —$CH_2CH(CH_3)$—OH and —$CH(CH_3)CH_2$—OH. Suitable $R^1$ groups are linear alkyl groups, for instance, linear R1 groups having from 8 to 14 carbon atoms.

Suitable cationic mono-alkoxylated amine surfactants for use herein are of the formula $R^1(CH_3)(CH_3)N^+(CH_2CH_20)_2X$— wherein $R^1$ is $C_{10}$-$C_{18}$ hydrocarbyl and mixtures thereof, especially $C_{10}$ to $C_{14}$ alkyl, or $C_{10}$ to $C_{20}$ alkyl, and $X^-$ is any convenient anion to provide charge balance, for instance, chloride or bromide ion.

As noted, surfactants of the foregoing type include those wherein the ethoxy ($CH_2CH_2O$) units (EO) are replaced by butoxy, isopropoxy [$CH(CH_3)CH_2O$] and [$CH_2CH(CH_3)O$] units (i-Pr) or n-propoxy units (Pr), or mixtures of EO and/or Pr and/or i-Pr units.

Suitable cationic bis-alkoxylated amine surfactants may have the general formula: $R^1R^2N^+A_pR^3A'_qR^4X$— wherein $R^1$ is an alkyl or alkenyl moiety containing from about 8 to about 18 carbon atoms, or from 10 to about 16 carbon atoms, or from about 10 to about 14 carbon atoms; $R^2$ is an alkyl group containing from one to three carbon atoms, for instance, methyl; $R^3$ and $R^4$ can vary independently and are selected from hydrogen, methyl and ethyl, X— is an anion such as chloride, bromide, methylsulfate, sulfate, or the like, sufficient to provide electrical neutrality. A and A' can vary independently and are each selected from $C^1$-$C^4$ alkoxy, for instance, ethoxy, (i.e., —$CH_2CH_2O$—), propoxy, butoxy and mixtures thereof, p is from 1 to about 30, or from 1 to about 4 and q is from 1 to about 30, or from 1 to about 4, or both p and q are 1.

Suitable cationic bis-alkoxylated amine surfactants for use herein are of the formula $R^1CH_3N^+(CH_2CH_2OH)(CH_2CH_2OH)X^-$, wherein $R^1$ is $C_{10}$-$C_{18}$ hydrocarbyl and mixtures thereof, or $C_{10}$, $C_{12}$, $C_{14}$ alkyl and mixtures thereof, $X^-$ is any convenient anion to provide charge balance, for example, chloride. With reference to the general cationic bis-alkoxylated amine structure noted above, since in one example compound $R^1$ is derived from (coconut) $C_{12}$-$C_{14}$ alkyl fraction fatty acids, $R^2$ is methyl and $A_pR^3$ and $A'_qR^4$ are each monoethoxy.

Other cationic bis-alkoxylated amine surfactants useful herein include compounds of the formula: $R^1R^2N^+$—$(CH_2CH_2O)_pH$—$(CH_2CH_2O)_qH$ X— wherein $R^1$ is $C_{10}$-$C_{18}$ hydrocarbyl, or $C_{10}$-$C_{14}$ alkyl, independently p is 1 to about 3 and q is 1 to about 3, $R^2$ is C1-C3 alkyl, for example, methyl, and $X^-$ is an anion, for example, chloride or bromide.

Other compounds of the foregoing type include those wherein the ethoxy ($CH_2CH_2O$) units (EO) are replaced by butoxy (Bu) isopropoxy [$CH(CH_3)CH_2O$] and [$CH_2CH(CH_3)O$] units (i-Pr) or n-propoxy units (Pr), or mixtures of EO and/or Pr and/or i-Pr units.

Additional Adjuncts

Optionally, other adjuncts may be employed in the compositions of the present invention to provide other performance benefits such as cleaning, and/or desirable physical property modification, such as for example rheological modification, thickening and the like. Further adjuncts may be employed for chemical stability, biological stability and the like. Other adjuncts may be employed for aesthetic purposes as well, including dyes, colorants, fragrances and the like.

Cleaning Agent

Suitable cleaning agents include the optional dispersants and surfactants described herein. Additionally, other suitable cleaning agents include builders, chelants, sequestrants, detergency aids, solvents, cosolvents, abrasives, wetting agents, spreading agents, evaporation modifiers, thickeners, and other materials commonly employed in the art to enhance the cleaning and removal of stains, soils, biological and environmental contaminants from the surfaces of those substrates and articles described herein.

Water

Compositions of the present invention may optionally include water in combination with another suitable liquid carrier, or optionally as the predominant liquid carrier, optionally in combination with one or more additional carriers, solvents and/or propellants as described herein. When water is employed, it may be deionized, industrial soft water, or any suitable grade of water. Water may be present in compositions of the associative complexes of the present invention in levels of 99.9 wt. % or less.

Method of Use

A wide variety of suitable application methods may be used to treat surfaces with the inventive compositions, including for example, but not limited to, pouring, spraying, application with a trigger sprayer, aerosol sprayer or device containing a pressurized propellant and/or condensed gas, spraying onto a surface from a container attached to a hose, wiping onto a surface with a pre-moistened disposable device such as for example, but not limited to, a nonwoven wipe, cloth and/or sponge wetted with the formulation. Suitable application methods include applying compositions of the associative complexes directly in either neat form, or concurrent with and/or following dilution of a concentrated composition with a suitable liquid carrier, such as for example water. Other suitable application methods include applying separate compositions of the polymeric constituent and the polymeric fluorosurfactant either simultaneously, consecutively, or intermittently to a surface of an article to be treated.

In one embodiment, the water soluble and/or water dispersible polymer or composition of the polymer in a suitable liquid carrier is first applied to a surface to be treated, followed optionally before or after drying, by application of the polymeric fluorosurfactant or composition thereof whereby the inventive associative complex is formed in situ on the surface to provide a treated article. In another embodiment, the polymer and polymeric fluorosurfactant components of the inventive associative complex are present as two separate compositions, for example two liquid compositions stored in two separate containers, or two liquid compositions stored in two separate chambers of a container, and application involves mixing or dispensing of the separate component compositions at time of use either simultaneously, or consecutively in order to form the inventive associative complexes either in situ in a treatment composition formed by mixing of the respective component compositions, or in situ on the surface of the substrate, whereby in contact with the treatment compositions a treated article bearing the associative complex on the surface is achieved.

In yet another embodiment, the polymer and polymeric fluorosurfactant components of the inventive associative complex are present as two separate compositions, for example two powdered, solid, granular, block or cake compositions, or mixtures thereof, in substantially dry form such that upon wetting or dissolution the inventive associative complex is formed in situ within the wetting solution. In an example embodiment and method for treating a toilet water system, the components are formed into a tablet that is placed into a toilet tank, where upon gradual dissolution over time, a composition containing the inventive associative complex is formed in situ in the aqueous tank reservoir, and all surfaces, including those continuously submerged and those intermittently contacted during flushing, are treated with the associative complexes thereby rendering the increased surface protection benefits described herein.

Suitable application means include both manual and automated delivery means for applying the components of the associative complexes to a surface to render a treated article. Compositions of the inventive associative complexes may optionally include cleaning agents and other adjuncts and hence provide simultaneous cleaning and treatment of surfaces. In one embodiment, a cleaning composition containing the inventive associative complexes and a cleaning agent is applied to a soiled surface, for example by means of a spray device or saturated wiping article, whereby soil and other residues are removed from the surface which is thereby simultaneous cleaned and treated to exhibit the surface protective properties owing to deposition of the associative complexes. In yet another embodiment, a surface or article previously treated with the inventive associative complexes becomes soiled and is cleaned using a second application of the inventive compositions, wherein the soiled previously treated article is more easily cleaned then a similarly soiled but untreated article such that an "easier cleaning" and/or "easier next time cleaning" benefit is associated with the second cleaning and treatment step.

Absorbent Materials

The treatment composition of the present invention can be used independently from or in conjunction with an absorbent and/or adsorbent material. For instance, the treatment composition can be formulated to be used in conjunction with a cleaning wipe, sponge (cellulose, synthetic, etc.), paper towel, napkin, cloth, towel, rag, mop head, squeegee, and/or other cleaning device that includes an absorbent and/or adsorbent material.

The cleaning wipe can be made of nonwoven material such as nonwoven, fibrous sheet materials or meltblown, coform, air-laid, spun bond, wet laid, bonded-carded web materials, and/or hydroentangled (also known as spunlaced) materials. The cleaning wipe can also be made of woven materials such as cotton fibers, cotton/nylon blends and/or other textiles. The cleaning wipe can also include wood pulp, a blend of wood pulp, and/or synthetic fibers, e.g., polyester, rayon, nylon, polypropylene, polyethylene, and/or cellulose polymers.

The absorbent material can be constructed as part of a single or multiple layer cleaning pad attached in either the wet or dry state to the end of a mop. The cleaning pads will preferably have an absorbent capacity, when measured under a confining pressure of 0.09 p.s.i. after 20 minutes, of at least about 1 g deionized water per g of the cleaning pad, preferably at least about 10 g deionized water per g of the cleaning pad.

When the cleaning formulation is incorporated in an absorbent material, the treatment composition may include an effective amount of release agent to increase the amount of polymer released from the cleaning wipe onto a surface. The release agent is preferably an ionic species designed to compete with the polymer for sites on the cleaning wipe thereby causing increased polymer release from the cleaning wipe during use of the cleaning wipe. The release agent may include a salt. A variety of different salts can be used such as, but not limited to, monovalent salts, divalent salts, organic salts, and the like. Preferably, the effective ionic strength of the release agent in the treatment composition is at least about $5\times10^{-3}$ M (moles/liter).

The absorbent material may in one embodiment serve as the treating means for distributing the inventive associative complex compositions onto the surfaces of the articles to be treated. In combination with a kit according to another embodiment of the present invention, instructions for treating a substrate with an absorbent wipe saturated with the inventive associative complex compositions would include the step of evenly distributing the liquid compositions across the article surface to simultaneously effect cleaning of the surface and renewal of the inventive associative complex present on the treated article surface. The same absorbent material, having dispensed its charge of treatment composition, or another absorbent material independent of the first, can then be used to effectively dry the treated surface without the need for rinsing with water, by the action of wiping the surface until substantially dry.

In yet another embodiment, the inventive compositions may be applied in a dry form to an absorbent carrier or applied via a liquid carrier that is allowed to dry or evaporate to deposit an essentially dry form of the inventive composition onto and/or within the absorbent material. In these embodiments, the absorbent material would be wetted with water or solvent prior to, or during use, for example in applying to a previously wetted surface, to activate the absorbent material and thereby enable release and transfer of the inventive associative complexes from the absorbent material to the surface of the substrate material to be treated.

In yet another embodiment, other adjuncts could also be deposited, applied or dried onto the absorbent material in combination with the inventive associative complexes to provide an essentially dry or dry-to-touch wipe or material that could be used to apply the inventive associative complexes to surfaces, either pre-wetted with water, or when activated with water or other suitable solvent effective in aiding transfer of the inventive compositions to the surface to be treated.

Kits

The inventive compositions may be provided for use in a kit form, wherein compositions of the associative complexes, either in the form of a single treatment composition or partial treatment compositions, are packaged in a suitable container and/or dispensing means, and further combined with instructions for treating surfaces of substrates to provide them with the surface protective properties as described herein. In one embodiment, a kit comprising a treatment composition of the associative complex in a suitable liquid carrier is packaged in a dispensing bottle, such as for example a bottle adapted to provide spraying of the treatment composition onto a surface, in combination with printed instructions according to the methods of the present invention for application of the treatment composition to at least one surface of a substrate, followed by removable of the treatment composition whereby an associative complex is formed on the surface thereby providing a surface protective film that is thin and invisible. In another embodiment, a kit comprising two (a first and a second) treatment compositions, wherein each partial treatment comprises one component of the associative complex of the present invention, are each packaged separately, for example in separate bottles adapted for application or loaded onto separate absorbent dispensing articles, or some combination thereof, combined with printed instructions according to the methods of the present invention for step wise application of the first and of the second treatment compositions to at least one surface of a substrate, whereby an associative complex is formed on the surface thereby providing a surface protective film that is thin and invisible.

Treating Porous Surfaces

The inventive compositions can be applied to porous surfaces in order to modify their surfaces to render them hydrophobic and oleophobic, thereby exhibiting improved surface protective properties against water, oil, soil, environmental and biological contamination. Depending on the pore size of the material treated with the inventive compositions, the bulk material may retain permeability with respect to water and oil, yet exhibit the beneficial hydrophobic surface modification of the microscopic aggregate such that the substrate material itself is impervious to water, oil and the like on a microscopic scale, and hence is provided a surface protective property, while not interfering with the bulk transfer properties of the material. Examples include, but are not limited to, concrete, macadam, stone, field tile, grout, mortar and limestone, which may be treated with the inventive compositions to provide microscopic surface protective properties on a scale related to the grain size of the corresponding aggregate or crystalline components, while maintaining the macroscopic or bulk properties. Thus, for example, a roadway treated with the inventive compositions would resist water and oil penetration into the grains, fine pores and boundaries, yet allow bulk water transfer from the surface through macroscopic pores and drainage channels to maintain a drivable surface when wet.

Treating Textile Surfaces

The inventive compositions can be applied to textiles to modify their surfaces to render them hydrophobic and oleophobic, thereby exhibiting improved surface protective properties against water, oil, soil, environmental and biological contamination, and further providing "easier cleaning" and easier "next time cleaning," particularly in a subsequent washing step using water and/or detergent. The textiles can be either woven or non-woven; the materials can be natural, for example cotton, synthetic, for example polyester, nylon and the like, and/or combinations of natural and synthetic fibers or materials. The specific fabric is not critical, and suitable articles for treatment by the inventive associative complexes and compositions thereof include for example, but are not limited to industrial textiles, clothing, upholstery, carpets, tarpaulins, draperies, awnings, and the like. The associative complexes of the current invention are especially suitable for use by consumers, through the application of compositions to these textiles in the normal cleaning of them.

Treating Hard Surfaces

The inventive compositions can be also applied to hard materials to modify their surfaces to render them hydrophobic and thereby exhibit improved surface protective properties against water, oil, soil, environmental and biological contamination, and further providing "easier cleaning" and easier "next time cleaning." Hard surface include those made from metal, plastic, stone both natural and synthetic, e.g., CORIAN, glass, ceramic, and the like. These are commonly found among household fixtures including, for example, tiles, bathtubs, and towel bowel, kitchen countertops, floors, and windows. In addition, the compositions can be used on the interior and exterior surfaces of hard surfaces found on common objects of construction, including, but not limited to exterior and interior surfaces of an airplane, automobile, bathtub, boat, building, ceiling, floor, electronic semiconductor substrate, fluid distributing system, household appliance, household fixture, micro fluidic device, shower, sink, ship, toilet, vehicle, wall, water distribution system, water recirculation system, window, and/or combinations thereof, and further including the finished and painted surfaces thereof.

Treating Particulate Materials

The inventive compositions can be also applied to particulate materials, that is materials in the form of a plurality of fine particles, to modify their surfaces to render them hydrophobic and thereby exhibit improved surface protective properties. Suitable particulate materials that may be treated according to the compositions and methods of the present invention include those materials comprising an inorganic oxide, metallic oxide, semiconductor oxide, clay, silica, silica gel, zeolite, and/or combinations thereof. Generally, when said particulate material is in the form of a plurality of particles, the particles have cross sectional dimensions of between 1 nanometer to 1000 microns.

Surface Protective Properties

Regardless of the surface or article treated, or of the particular application method used to apply or form the inventive associative complexes on the surfaces of the treated articles, the associative complexes provide enhanced surface protective properties, including water and/or oil resistance, water and/or oil repellency, soil repellency, water sheeting, easier cleaning, easier next time cleaning, and resistance to microbial and environmental contamination owing to the presence of the associative complexes deposited onto the treated article surface. The enhanced surface protective properties provided to the surfaces of substrates and articles treated using the inventive associative complexes are associated with improved cleaning and maintenance properties commonly described by terminology including easier cleaning, stays cleaner longer, easier next time cleaning, improved cleaning, faster cleaning, improved and/or extended protection, dirt repellency, soil repellency, microorganism repellency, reduced biofouling, reduced germ build-up, scale prevention, reduced soap scum deposition, reduced soiling, reduced cleaning time, and/or combinations thereof.

Without being bound by theory, it is believed that the associative complexes of the present invention form essentially invisible monolayer thin surface protective layers on the substrates treated, and thus provide surface modification exhibiting the desirable surface protective properties described above. In is further thought that unlike conventional films, sealants and/or coatings that rely on a macroscopic (i.e. thick) coating to provide essentially a physical barrier to water and oil penetration, that the associative complexes, by being deposited as polymer association complexes, readily conform to the atomic level topography of the surfaces onto which they are applied to essentially form extremely thin microscopic films with surprisingly high binding affinity, such that surface modification occurs without forming a visible film or visual distortion of the treated surface.

EXAMPLES

Analysis of Surfaces Modified with Associative Complexes

FT-IR spectroscopic analysis of hard surfaces can be used successfully to monitor the adsorption and desorption of the associative complexes of the present invention. One suitable FT-IR technique employs an optical accessory that utilizes the principle of attenuated total reflectance (ATR). In ATR experiments, the infrared radiation is transmitted through an internal reflection element (IRE). Any material that is in intimate contact with the IRE will be able to interact with the infrared radiation and generates an infrared spectrum of the material. The amount of absorbance of the infrared radiation, and hence the intensity of the absorption bands that appear in the spectrum, are directly proportional to the amount of an infrared absorbing material and the path length of the infrared radiation through the sample. The relative amounts of the polymeric fluorosurfactants and/or other materials that adsorb onto an IRE subjected to various treatments with the inventive formulations were monitored using FT-IR with ATR optical accessories from Harrick Scientific (Ossining, N.Y.). The IREs are made from germanium, which is an infrared transparent material that, when clean, has a "moderate" surface energy that is similar to many common substrate surfaces, such as glass, porcelain, ceramic tile, steel, and aluminum. The analysis of very small amounts of materials adsorbed on the surface of the IRE is routine and the relative intensities of the infrared absorption bands in the spectra can be used to distinguish the presence of a monolayer, and even a patchy, partial monolayer from a layer that is many thousands of molecules thick. FT-IR spectroscopy is described in Fourier Transform Infrared Spectrometry, by P. R. Griffiths and James A. de Haseth, John Wiley and Sons, Wiley-Interscience, 1986. ATR optical accessories are described in Internal Reflection Spectroscopy, By N. J. Harrick, Interscience Publishers, 1967, and Internal Reflection Spectroscopy Review and Supplement, by F. M. Mirabella Jr., N. J. Harrick, Editor, Harrick Scientific Corporation, 88 Broadway, Box 1288, Ossining, N.Y. 10562.

FT-IR spectroscopic analysis was also employed in the following experiments. One particularly convenient optical accessory used was a device that is commercially available as the HORIZON from Harrick Scientific Corp., (Ossining, N.Y.). This optical accessory employs internal reflection elements (IREs) with dimensions of 50×10×3 mm (millimeter). The IRE is mounted horizontally in the HORIZON, at the bottom of a "trough" that can contain about 2.5 mL (milliliter) of liquid. This design allows the surface of the IRE to be immersed in a solution and easily rinsed while remaining in place in the FT-IR spectrometer. A wide variety of protocols for treatment of the surfaces of IRE with treatment compositions are possible with this accessory. A known volume of a treatment composition can be applied to the surface of the IRE with a micro syringe and allowed to dry. The FT-IR spectrum of the film formed by the treatment composition can be obtained. Alternatively, the trough of the Horizon accessory can be filled with a sample of a liquid treatment composition, followed by a reproducibly timed exposure period, during which any thermodynamically favored adsorption onto the IRE surface is allowed to occur, without a drying step. Immediately after the exposure step, the treatment composition can be rapidly removed from the trough and rinsing steps begun. A liquid treatment composition or rinse water can be rapidly removed from the trough with the use of a pipette tip fitted to the end of a length of tubing to which vacuum is applied. Using this approach, solutions can be rapidly "vacuumed" off the surface of the IRE. The fill and empty procedure constitutes one rinse cycle of the treated IRE surface. Since the IRE surface area and the trough volume are fixed, very reproducible rinsing of treated IREs can be accomplished for the comparison of the effects of compositions by FT-IR spectroscopy.

After a treatment of the IRE surface, or during a rinsing cycle, the surface of the IRE, which appears smooth and mirror-like, can be visually inspected for the presence of any residue or visible film. In addition, the behavior of the first few drops of rinse water applied to the surface of the IRE can be observed. If the surface of the IRE has been rendered more surface protective and/or hydrophobic by the treatment, water drops will tend to bead up and not readily spread on the surface, in contrast to the behavior of a clean IRE surface, which is relatively hydrophilic, and hence will exhibit spreading of the water and reduced water beading.

A convenient method for controlling the atmosphere over the IRE surface is as follows: A small enclosure (8 cm×3 cm×3 cm) that fits over the exposed trough is constructed from glass or plastic. Into this enclosure through flexible plastic tubing is directed extremely dry air or nitrogen (dew point approximately −100° F.) at a rate between 5 and 10 standard cubic feet per hour (SCFH). The dry air or nitrogen can be from the same source used to purge the interior of the FT-IR spectrometer, which is a typical practice. This approach allows the rapid and very complete drying of the surface of the IRE by covering it with a blanket of dry, flowing gas. In order to expose the IRE surface to the atmosphere, the small enclosure is removed. The FT-IR spectra of the IRE surface in the ambient atmosphere, or under extremely dry conditions, can thus be obtained.

Using FT-IR spectroscopy, a "background" or "single beam" spectrum of the clean IRE itself must be recorded first. The single beam spectrum of the IRE after adsorption or deposition of treatment compositions on the surface of the IRE is first recorded, and the final normal spectrum of the IRE of the resulting deposited material is then computed fron the ratio of these two single beam spectra. In the experiments described herein, the background spectrum of the IRE is obtained under the stream of dry air. The IREs are cleared before each treatment by polishing with an alumina slurry (0.05 micrometer particles), followed by extensive rinsing with water, methanol, and then water again In this manner. reproducible background spectra and hence final background corrected spectra of adsorbed layers of material that are less than a monolayer thick can be routinely obtained by those skilled in the art.

The FT-IR spectra of the polymeric fluorosurfactant components of the associative complexes of the present invention exhibit significant absorbance bands due to C—F stretching modes corresponding to the various fluoroalkyl substituent groups present. Thus, the relative amounts of fluorosurfactant present on the surface of the IRE can be monitored by the intensity (in Absorbance units, AU, or milli-Absorbance units mAU) of these bands in the spectra obtained. The frequencies of these highly characteristic bands in the spectra of all of the fluorosurfactants vary only slightly, falling between about 1250 to 1200 $cm^{-1}$ and a second band between about 1150 to 1100 $cm^{-1}$. Absorbance Intensities of these bands are used in the examples herein below to illustrate the relative amount of polymeric fluorosurfactant present within the associative complexes of the present invention adsorbed onto the surface of the IRE substrate, which acts as a model surface.

The following examples illustrate the utility and performance of various embodiments of types of associative complexes comprising water soluble and/or water dispersible polymers and polymeric fluorosurfactants of the present invention used to treat example surfaces by employing compositions comprising these associative complexes and/or compositions with one or more components of the associative complex combined with methodology to form the associative complexes in situ on the surface of a treated article. The examples and materials presented below are illustrative of embodiments of the present invention and are not meant to be limiting with regards to the scope of the invention.

Example 1

Example 1 illustrates the effect of compositional variations on the relative amount of fluorosurfactant adsorbed onto the Ge IRE surface achieved by employing treatment compositions, as shown in Table 1, of the present invention where the associative ratio, R, of the associative complexes are varied, in comparison to control compositions.

Table 2 summarizes the C—F band intensities due to adsorbed fluorosurfactant present as a result of the absorbed Type I associative complexes of Example 1 compositions. In these experiments, the IRE was exposed to the indicated treatment composition for 5 minutes, followed immediately by removal of the compositions and 20 rinses with deionized water, to remove any residual unabsorbed materials. Thus, the modification of the IRE surface was achieved without drying or curing of the treatment cleaner compositions, but rather only by the rapid spontaneous adsorption of the associative complexes of the present invention. As seen in Table 2, the unassociated polymeric fluorosurfactant (Control composition 2) does not adsorb significantly in the absence of the polymer. Inspection of the raw FT-IR spectra also indicate that other absorbance bands due to PDADMAC molecules that fall near the frequencies of the C—F bands are very weak and hence did not interfere with the detection of the adsorbed fluorosurfactant.

Comparing the amounts of adsorbed fluorosurfactant from compositions 1, 2 and 3, it is clear that decreasing values of R by modifying the relative amounts of the polymer and fluorosurfactant in the associative complex results in increased fluorosurfactant adsorption and increasing degree of surface modification achieved. Even when the amount of the overall associative complex present is reduced, significant adsorption of the fluorosurfactant and modification of the surface can be achieved, by slightly increasing the R associative complex ratio, as demonstrated by results employing treatment composition 4. In this embodiment, the mechanism of adsorption of the associative complex appears pH independent, as high amounts of the fluorosurfactant and corresponding modification of the surface can be achieved over a wide pH range as illustrated by results obtained with treatment compositions 5 and 6.

TABLE 1

| | Compositions | | | | | | | |
|---|---|---|---|---|---|---|---|---|
| | A (Control) | B (Control) | 1 | 2 | 3 | 4 | 5 | 6 |
| Ingredients (wt %) | | | | | | | | |
| Surfonic L12-8 | — | 2.0 | 2.0 | 2.0 | 2.0 | 2.23 | 2.16 | 2.16 |
| PDADMAC | 0.01 | — | 0.0114 | 0.0144 | 0.0114 | 0.00552 | 0.0101 | 0.0101 |
| PolyFox 156A | — | 0.08 | 0.0212 | 0.0813 | 0.133 | 0.05055 | 0.08024 | 0.08024 |
| DI Water (to 100%) | q.s. | q.s. | q.s. | q.s. | q.s. | q.s. | q.s. | q.s. |
| Parameters: | | | | | | | | |
| R | — | — | 2.994 | 0.781 | 0.477 | 0.610* | 0.706 | 0.706 |
| pH | 2.5 | 8.6 | 9.6 | 9.6 | 9.6 | 8.0 | 2.5 | 8.63 |

*Calculation example: $C_p = 0.00552$, $C_f = 0.05055$ with $F_p$, $Q_p$, $Q_f$ and monomer MW's as provided in Chemical Key. $G_p = 3.43 \times 10^{-5}$, $G_f = 5.62 \times 10^{-5}$ yielding $R = G_p/G_f = 0.610$.

TABLE 2

| Composition | C—F Band Absorbance 1205 $cm^{-1}$ | C—F Band Absorbance 1105 $cm^{-1}$ | IRE Appearance | Surface behavior |
|---|---|---|---|---|
| Control A | 0.000517 | 0.000722 | No water beading | Hydrophilic |
| Control B | 0.001333 | 0.001013 | No water beading | Hydrophilic |
| 1 | 0.000303 | 0.000377 | Weak water beading | Weakly hydrophobic |
| 2 | 0.008807 | 0.005502 | Beads water | Strongly hydrophobic |
| 3 | 0.02450 | 0.01482 | Beads water | Strongly hydrophobic |
| 4 | 0.005408 | 0.00373 | Beads water | Strongly hydrophobic |
| 5 | 0.004906 | 0.00377 | Beads water | Strongly hydrophobic |
| 6 | 0.006491 | 0.004113 | Beads water | Strongly hydrophobic |

Chemical Key

Copolymer A=amphoteric (1.7:1.0 acrylic acid:methacrylolamidopropyl pentamethyl propylene-2-ol-ammonium chloride) copolymer, Mirapol CP-3, available from Rhodia, Inc. Diquaternary monomer molecular weight (MW)=357.8 g/mole with weight fraction (1.0 mole fraction), $F_p$=0.7451 with $Q_p$=2.0. Acrylic monomer MW=72 g/mole with weight fraction (1.7 mole fraction)=0.2549, based on monomer mole av. (average) MW=480.2 g/mole.

PDADMAC=poly(diallyl dimethyl ammonium chloride), Av. MW=100,000 to 200,000 available from Aldrich Chemical Co., lot 15215AB. Monomer MW=161 g/mol, $F_p$=1.0 and $Q_p$=1.0.

PAA=poly(acrylic acid), Aquatreat AR-4, available from Alco Chemical Co. Monomer MW=72 g/mole, homopolymer with $F_p$=1.0 and $Q_p$=1.0.

Lupasol P=poly(ethyleneimine) available from BASF Industries. Monomer MW=43 g/mole, homopolymer with $F_p$=1.0 and $Q_p$=1.0.

Copolymer B=nonionic (1:1 vinyl pyrrolidone:vinyl imidazole) copolymer, Luvitec VPI 55 K72W available from BASF. Monomer MW=111 g/mole, vinyl pyrrolidone monomer is 50 mole percent, $F_p$=0.5, with one ester per monomer, $Q_p$=1.0.

PolyFox 156A=anionic salt of fluoropolyether disulfate, $R_f$=$C_2F_5$—, available from Omnova Solutions, Inc. Av. MW=1800 g/mole, $Q_f$=2.0.

PolyFox AT-1001=cationic ammonium fluorosurfactant, chloride salt, $R_f$=$C_4F_9$—, available from Omnova Solutions, Inc. Av. MW=1112 g/mole, $Q_f$=1.0

PolyFox AT-1002=anionic salt of fluoropolyether disulfate, $R_f$=$C_4F_9$—, available from Omnova Solutions, Inc. Av. MW=1737.8 g/mole, $Q_f$=2.0.

PolyFox 1121=nonionic hydroxyl-terminated polymeric fluorosurfactant, available from Omnova Solutions, Inc. Av. MW=3700 g/mole, with diol functionality $Q_f$=2.0.

Surfonic L12=nonionic alkyl ethoxylate surfactant, available from Huntsman Chemical Co.

Dowanol EB=ethylene glycol mono-butyl ether, glycol ether solvent, available from Dow Corp.

DI Water=deionized and/or distilled water.

Example 2

Example 2 illustrates the effect of optional addition of a cleaning and/or dispersing aid to the inventive compositions with regard to the relative amount of fluorosurfactant adsorbed onto the Ge IRE surface. In this experiment, the IRE was exposed to the compositions shown in Table 3 for 5 minutes, followed immediately by removal of the compositions and 20 rinses with deionized water to remove residual unadsorbed materials. Results in Table 4 demonstrate that modification of the IRE surface was achieved without drying or curing of the cleaner compositions, indicating that the inventive associative complexes are rapid and spontaneous adsorbed onto the treated surface.

Without being bound by theory, it is believed that stable associative complexes of the polymer and the polymeric fluorosurfactant are formed in solution, and that an optional cleaning and/or dispersing aid, in this example a common nonionic surfactant present in the composition, can be used to adjust the amount of adsorption of the fluorosurfactant that occurs within 5 minutes, likely by changing the kinetics of the adsorption of the associative complex onto the surface. Composition 8 with included nonionic surfactant as a cleaning adjunct, demonstrates increased adsorption of the associative complexes of the present invention as indicated by the increased amount of fluorosurfactant detected by FT-IR, and the extent of visual modification of the IRE surface versus composition 7. Further increasing the amount of the optional surfactant in the composition is believed to alter the average composition of the mixed micelles comprising the optional surfactant and the Type I associative complexes of the polymeric fluorosurfactant and the polymer. This appears to only slightly retard absorption of the associative complex, and as results for composition 9 reveal in Table 3, significant adsorption of fluorosurfactant and successful modification of the surface is still achieved, due to the thermodynamically favored adsorption of the associative complexes of the present invention even in the presence of an optional cleaning aid and/or dispersant material that possesses some surface active properties.

TABLE 3

| | Compositions | | |
|---|---|---|---|
| | 7 | 8 | 9 |
| Ingredients (wt %) | | | |
| Surfonic L12-8 | 0.00 | 0.587 | 2.09 |
| PDADMAC | 0.005359 | 0.00528 | 0.00528 |
| PolyFox 156A | 0.0507 | 0.0467 | 0.0550 |
| DI Water (to 100%) | q.s. | q.s. | q.s. |
| Parameters: | | | |
| R | 0.590 | 0.628 | 0.536 |

TABLE 4

| Composition | C—F Band Absorbance, 1205 $cm^{-1}$ | C—F Band Absorbance, 1105 $cm^{-1}$ | IRE Appearance | Surface behavior |
|---|---|---|---|---|
| 7 | 0.000624 | 0.000236 | Weak water beading | Partially hydrophobic |
| 8 | 0.01092 | 0.007002 | Beads water | Hydrophobic |
| 9 | 0.006936 | 0.00446 | Beads water | Hydrophobic |

Example 3

Example 3 illustrates how the compositions can influence the relative amount of fluorosurfactant adsorbed onto the IRE surface and the kinetics of adsorption when the amount of the associative complex is increased and the associative complex molar ratio parameter, R, is varied in the presence of the optional cleaning/dispersing agent. In these experiments, the IRE was exposed to the cleaner formulation for different amounts of time, followed immediately by removal of the compositions and 20 rinses with deionized water, to remove residual unadsorbed materials.

Results shown in Table 6 demonstrate that the amount of adsorbed fluorosurfactant increases with exposure time for all formulations of Table 5, which is due to the thermodynamically favorable adsorption described herein above. Composition 10 has a relatively high R value, resulting in lower adsorption of fluorosurfactant at 5 minutes than in the case of other embodiments wherein the amounts of polymeric fluorosurfactant and polymer are adjusted to provide a smaller R value. However, increasing the exposure time of Composition 10 results in a significant increase in the amount of fluorosurfactant adsorbed. Composition 11 contains about 22.4% of the polymeric fluorosurfactant of Composition 10, but a significantly smaller R value. Thus, at an exposure time of 96 minutes, the amount of fluorosurfactant adsorbed from Composition 11 is about 70% of that adsorbed from Composition 10.

Composition 12 is a further embodiment that demonstrates that, with longer exposure times, adsorption of fluorosurfactant is favored. This example demonstrates the robustness of the associative complexes of the present invention and means for optimizing the amount of adsorbed fluorosurfactant depending on the amount of adsorption time available. Long adsorption times might be encountered in cases such as toilet bowl interiors, below the water line, or in other submersed surfaces such as recirculating cooling tower waters.

TABLE 5

| | Compositions | | |
|---|---|---|---|
| | 10 | 11 | 12 |
| Ingredients (wt %) | | | |
| Surfonic L12-8 | 1.99 | 2.36 | 2.20 |
| PDADMAC | 0.02136 | 0.00298 | 0.00300 |
| PolyFox 156A | 0.07841 | 0.0176 | 0.02113 |
| DI Water (to 100%) | q.s. | q.s. | q.s. |
| Parameters: | | | |
| R | 1.524 | 0.949 | 0.795 |

TABLE 6

| Composition | C—F Band Absorbance 1205 $cm^{-1}$ | % Change C—F Band Absorbance 1205 $cm^{-1}$ | C—F Band Absorbance 1105 $cm^{-1}$ | % Change C—F Band Absorbance, 1105 $cm^{-1}$ | IRE Exposure Time (min.) |
|---|---|---|---|---|---|
| 10 | 0.002514 | — | 0.001675 | — | 5 |
| 10 | 0.006363 | +153 | 0.004610 | +175 | 110 |
| 11 | 0.00103 | — | 0.000883 | — | 5 |
| 11 | 0.00445 | +332 | 0.00323 | +265 | 96 |
| 12 | 0.001241 | — | 0.001157 | — | 5 |
| 12 | 0.00927 | +647 | 0.00617 | +433 | 810 |

Example 4

Example 4 illustrates the effects of multiple exposures of the IRE surface to several embodiment compositions, demonstrating the resistance of the absorbed associative complexes against rinsing and extended water exposure time.

In these experiments, the IRE was exposed to embodiment formulations for 5 minutes, followed immediately by removal of the compositions and 20 rinses with deionized water to remove residual unadsorbed materials. After recording the FT-IR spectrum of the adsorbed layer formed during the first exposure, a second 5 minute exposure to the same composition was performed, followed again by removal of the composition and 20 rinses with deionized water, after which the FT-IR spectrum of the adsorbed layer formed by these two exposures was obtained. Results in Table 8 demonstrate that, for the independently tested, but similar compositions 13 and 14, that the amount of adsorbed fluorosurfactant is rapidly established in the first exposure, and that this adsorbed layer is stable to a second exposure to the compositions, which is due to the thermodynamically favored adsorption and subsequent stability of the associative complexes of the present invention. Composition 15 delivers relatively more adsorbed fluorosurfactant during the first and second exposures of the surface, because of the relatively smaller R value, as taught herein above.

The long-term water-resistance or substantivity of two of the adsorbed layers of the associative complexes were also tested. Deionized water was added to the trough of the Horizon and left in place (covered to prevent evaporation) for between 12 to 15 hours. The water was then removed and a spectrum of the layer of adsorbed fluorosurfactant obtained. The results in Table 8 demonstrate that the amounts of adsorbed fluorosurfactant delivered by compositions 14 and 15 are not significantly affected by long-term immersion in water. Further, the surface of the IRE treated with Formulations 14 and 15 remained visually hydrophobic (beading water) after the water exposures, due to the presence of the adsorbed fluorosurfactant.

TABLE 7

| | Composition | | |
|---|---|---|---|
| | 13 | 14 | 15 |
| Ingredients (wt %) | | | |
| Surfonic L12-8 | 2.23 | 2.07 | 2.08 |
| PDADMAC | 0.00552 | 0.004953 | 0.00491 |
| PolyFox 156A | 0.05055 | 0.04448 | 0.05526 |

TABLE 7-continued

| | Composition | | |
|---|---|---|---|
| | 13 | 14 | 15 |
| DI Water (to 100%) | q.s. | q.s. | q.s. |
| Parameters: | | | |
| R | 0.610 | 0.622 | 0.497 |

TABLE 8

| Composition | C—F Band Absorbance 1205 $cm^{-1}$ | % Change C—F Band Absorbance 1205 $cm^{-1}$ | C—F Band Absorbance 1105 $cm^{-1}$ | % Change of C—F Band Absorbance 1105 $cm^{-1}$ | Treatment Cycle # | Duration (min.) |
|---|---|---|---|---|---|---|
| 13 | 0.005408 | — | 0.003732 | — | 1 | 5 |
| 13 | 0.005609 | +3.7 | 0.003906 | +4.7 | 2 | 5 |
| 14 | 0.004988 | — | 0.003246 | — | 1 | 5 |
| 14 | 0.004662 | −6.5 | 0.003004 | −7.5 | 2 | 5 |
| 14 | 0.004653 | −0.19 | 0.002846 | −5.3 | 3 | 900 |
| 15 | 0.00666 | — | 0.004415 | — | 1 | |
| 15 | 0.00785 | +17.9 | 0.005278 | +19.5 | 2 | 5 |
| 15 | 0.00833 | +6.1 | 0.005626 | +6.6 | 3 | 5 |

Example 5

Example 5 illustrates the effects of multiple exposures of the IRE surface to several embodiments in which R value is significantly decreased in inventive compositions containing very high levels of the polymeric fluorosurfactant with optional surfactant present, for 5 minutes, followed immediately by removal of the compositions and 20 rinses with deionized water, to remove residual unadsorbed materials. After recording the FT-IR spectrum of the adsorbed layer formed during the first exposure, a second 5-minute exposure was done, followed again by removal of the composition and 20 rinses with deionized water, after which the FT-IR spectrum of the adsorbed layer formed by these two exposures was obtained.

TABLE 9

| | Compositions | |
|---|---|---|
| | 16 | 17 |
| Ingredients (wt %) | | |
| Surfonic L12-8 | 2.077 | 2.12 |
| PDADMAC | 0.002582 | 0.01043 |
| PolyFox 156A | 0.07995 | 1.176 |
| DI Water (to 100%) | q.s. | q.s. |
| Parameters: | | |
| R | 0.180 | 0.0496 |

TABLE 10

| Composition | C—F Band Absorbance 1205 $cm^{-1}$ | % Change C—F Band Absorbance 1205 $cm^{-1}$ | C—F Band Absorbance 1105 $cm^{-1}$ | % Change C—F Band Absorbance 1105 $cm^{-1}$ | Treatment Cycle # | Duration (min.) |
|---|---|---|---|---|---|---|
| 16 | 0.005895 | — | 0.004334 | — | 1 | 5 |
| 16 | 0.011592 | +96.6 | 0.008122 | +87.4 | 2 | 5 |
| 17 | 0.002183 | — | 0.001891 | — | 1 | 5 |
| 17 | 0.003076 | +40.9 | 0.002617 | +38.4 | 2 | 5 |

Results in Table 10 demonstrate that significant adsorption of polymeric fluorosurfactant can be delivered from formulations in which the R value does not exceed 0.1. The formation of the associative complexes of the present invention depends on several interactions between the polymeric fluorosurfactant and water soluble and/or water dispersible polymer, and any optional surfactant cleaning aid that may be included. In the case of the compositions demonstrated in Example 5, there is a significant excess anionic charge due to fluorosurfactant relative to the cationic charge due to the polymer, and adsorption of fluorosurfactant still occurs. Thus, the Type I and Type III associative complexes of the present invention and the efficiency of surface modification is not limited to a simple stoichiometric relationship or ion-pair formation between the ionic groups present on the polymeric fluorosurfactant or water soluble and/or water dispersible polymer, and hence exhibit utility for values of R well below 0.1 and up to about 20.

Example 6

Example 6 illustrates the effects of composition on the adsorption of a polymeric fluorosurfactant incorporating more hydrophobic pendant fluorinated side chains, in this embodiment a fluorosurfactant with perfluorobutyl, i.e., $C_4F_9$ groups.

In these experiments, the IRE was exposed to the cleaner formulations for 5 minutes, followed immediately by removal of the compositions and 20 rinses with deionized water, to remove residual unadsorbed materials. In addition, a second and a third exposure of the IRE to Composition E were made, the latter for 14 hours. As in the other experiments, the IRE was rinsed 20 times after exposures 2 and 3, to remove unadsorbed components.

The results in Table 12 demonstrate that only a very small amount of the anionic polymeric fluorosurfactant (Control composition C) adsorbs in the absence of the associative complexes of the present invention, even though a relatively high concentration of the fluorosurfactant is used. In contrast, compositions containing the associative complexes of the present invention deliver significant amounts of adsorbed fluorosurfactant. Compositions with larger R values are also useful for surface modification, by extending the exposure time during which treated surface may be exposed yet retain their favorable surface protective properties.

TABLE 11

| | Compositions | | | | |
|---|---|---|---|---|---|
| | C | 18 | 19 | 20 | 21 |
| Ingredients (wt %) | | | | | |
| Surfonic L12-8 | 0 | 2.05 | 2.00 | 2.00 | 2.00 |
| PDADMAC | 0 | 0.0128 | 0.0027 | 0.0028 | 0.0027 |
| PolyFox AT-1002 | 1.00 | 0.0795 | 0.0236 | 0.0527 | 0.0175 |
| DI Water (to 100%) | q.s. | q.s. | q.s. | q.s. | q.s. |
| Parameters: | | | | | |
| R | — | 0.819 | 0.627 | 0.283 | 0.845 |

TABLE 12

| Compositions | C—F Band Absorbance 1205 cm−1 | C—F Band Absorbance 1105 cm−1 | Treatment Cycle # | Duration (min.) |
|---|---|---|---|---|
| Control C | 0.001090 | 0.000659 | 1 | 5 |
| 18 | 0.00996 | 0.005889 | 1 | 5 |
| 19 | 0.008556 | 0.004086 | 1 | 5 |
| 20 | 0.006307 | 0.003329 | 1 | 5 |
| 21 | 0.002929 | 0.001401 | 1 | 5 |
| 21 | 0.003966 | 0.002059 | 2 | 5 |
| 21 | 0.012977 | 0.005789 | 3 | 840 |

Example 7

Example 7 illustrates how Type I associative complexes of the present invention can be made in one embodiment employing a polymeric fluorosurfactant bearing a permanent cationic charge and an anionically charged water soluble and/or water dispersible polymer.

In these experiments, the IRE was exposed to the cleaner formulations containing an associative complex and an optional cleaning aid for 5 minutes, followed immediately by removal of the compositions and 20 rinses with deionized water, to remove residual unadsorbed materials. In addition, a second exposure of the IRE was made for the times indicated. As in the other experiments, the IRE was also rinsed 20 times after exposure 2, to remove unadsorbed components.

The results in Table 14 demonstrate that the formulations containing the associative complexes of the present invention deliver adsorbed polymeric cationic fluorosurfactant to the IRE surface, which was rendered visibly hydrophobic by all the formulations. Composition 22, which demonstrates a significant increase in adsorption over a 14 hour exposure time, would be particularly suitable for the treatment of surfaces that are continually submerged in water, such as for example below the water line in toilet bowls or urinals. Compositions 23 and 24, having somewhat lower R values, deliver significant amounts of polymeric cationic fluorosurfactant with shorter exposure times. All the results are consistent with the thermodynamically favored adsorption of the associative complexes taught herein above.

TABLE 13

| | Compositions | | |
|---|---|---|---|
| | 22 | 23 | 24 |
| Ingredients (wt %) | | | |
| Surfonic L12-8 | 2.01 | 1.99 | 2.00 |
| PAA | 0.01342 | 0.004819 | 0.01341 |
| PolyFox AT-1001 | 0.01337 | 0.05678 | 0.1916 |
| NaOH | 0.00724 | 0.00516 | 0.00804 |
| DI Water (to 100%) | q.s. | q.s. | q.s. |
| Parameters: | | | |
| R | 15.50* | 1.311 | 1.082 |
| pH | 9.3 | 9.3 | 9.3 |

*Calculation example: $C_p = 0.01342$, $C_f = 0.01337$ with $F_p$, $Q_p$, $Q_f$ and monomer MW's as provided in Chemical Key. $G_p = 1.864 \times 10^{-4}$, $G_f = 1.202 \times 10^{-5}$ yielding R = Gp/Gf = 15.50.

TABLE 14

| Composition | C—F Band Absorbance 1240 cm−1 | C—F Band Absorbance 1134 cm−1 | Treatment Cycle # | Duration (min.) |
|---|---|---|---|---|
| 22 | 0.00249 | 0.002278 | 1 | 5 |
| 22 | 0.006138 | 0.005708 | 2 | 840 |
| 23 | 0.003088 | 0.002713 | 1 | 5 |
| 23 | 0.003849 | 0.003422 | 2 | 5 |
| 24 | 0.004948 | 0.004609 | 1 | 5 |
| 24 | 0.004964 | 0.004615 | 2 | 5 |

Example 8

Example 8 demonstrates how the associative complexes (here Type I) of the present invention can be made from an anionically charged polymeric fluorosurfactant and a water soluble amphoteric co-polymer, and optionally employing a two-step process. In the first step, the surface is exposed to Composition 25 containg the associative complexes, delivering some adsorbed polymeric fluorosurfactant. After the exposure, the composition was immediately removed, and the surface rinsed 20 times to removed unadsorbed components. Thus, the adsorbed layer was formed without the need for a drying or curing step, due to the thermodynamically favored adsorption described herein above. In the second step, the surface is re-exposed to a solution of the polymeric fluorosurfactant, (Composition D), followed by removal of the composition and 20 rinses with water, resulting in additional adsorption of the fluorosurfactant on the surface. Such a two-step method for preparing and maintained a treated surface or article may be preferred in some cases, for example in cleaning or restoring an initially very heavily soiled or otherwise damaged surface, or in providing a visible cue in the form of a visible change in the water repellency of the surface between the first and second exposures.

The FT-IR spectrum of the amphoteric polymer used in this example exhibits an absorbance band owing to amide linkages of the cationic monomer between 1670 $cm^{-1}$ and 1660 $cm^{-1}$, and another owing to the carboxylate groups of the ionized arylic acid monomer between 1580 $cm^{-1}$ and 1550 $cm^{-1}$. Inspection of the raw spectra also indicated that the spectrum of the amphoteric copolymer did not contain major bands that would seriously interfere with the C—F bands in the spectrum of the polymeric fluorosurfactant. Thus, the presence of the amphoteric polymer adsorbed on the surface of the IRE can be monitored using these bands. These band intensities are included in Table 16.

The data in Table 16 demonstrate that adsorption of the polymeric fluorosurfactant onto the surface occurs during the first exposure, and that significantly more fluorosurfactant is adsorbed onto the surface during the second exposure. Thus, adsorption of polymeric fluorosurfactant from a composition containing the associative complexes of the present invention can be used to modify a surface, and subsequent treatment of the surface with additional fluorosurfactant causes the formation of additional amounts of the associative complexes directly on the surface. Thus, in this particular embodiment of the present invention, a method of forming or renewing a deposited associative complex in situ on a treated article or surface of a substrate is demonstrated.

TABLE 15

| | Compositions | |
|---|---|---|
| | D | 25 |
| Ingredients (wt %) | | |
| Surfonic L12-8 | 0 | 2.06 |
| Amphoteric Copolymer A | 0 | 0.005540 |
| PolyFox 156A | 1.0 | 0.0598 |
| DI Water (to 100%) | q.s. | q.s. |
| Parameters: | | |
| R | — | 0.347* |
| pH | 4.4 | 4.4 |

*Calculation example: $C_p = 0.00554$, $C_f = 0.0598$ with $F_p$, $Q_p$, $Q_f$ and monomer MW's as provided in Chemical Key. $G_p = 2.307 \times 10^{-5}$, $G_f = 6.644 \times 10^{-5}$ yielding $R = G_p/G_f = 0.347$.

TABLE 16

| Treatment | C—F Band Absorbance 1205 cm−1 | C—F Band Absorbance 1105 cm−1 | Amide Band of Amphoteric Copolymer A Absorbance 1665 cm−1 | Carboxylate Band of Amphoteric Copolymer A Absorbance 1573 cm−1 | Treatment Cycle # (Treatment) | Exposure Time (min) |
|---|---|---|---|---|---|---|
| 25 | 0.002951 | 0.002152 | 0.002619 | 0.003113 | 1 (25) | 240 |
| 25 + D | 0.005872 | 0.003749 | 0.001322 | 0.000941 | 2 (D) | 5 |

TABLE 17

| | Composition | |
|---|---|---|
| | 26 | 27 |
| Ingredients (wt %) | | |
| Surfonic L12-8 | 0.2942 | 0.3148 |
| PDADMAC | 0.01042 | 0.01383 |
| PolyFox 156A | 0.04028 | 0.06252 |
| Dowanol EB | 1.95 | 1.91 |
| DI Water (to 100%) | q.s. | q.s. |
| Parameters: | | |
| R | 1.445 | 1.238 |

TABLE 18

| Composition | C—F Band Absorbance 1205 $cm^{-1}$ | C—F Band Absorbance 1105 $cm^{-1}$ | Treatment Dried followed by Rinsing (rinse #) |
|---|---|---|---|
| 26 | 0.02082 | 0.01386 | 20 |
| 26 | 0.01789 | 0.01163 | 40 |
| 27 | 0.02339 | 0.01524 | 20 |
| 27 | 0.01868 | 0.01231 | 40 |

The data in Table 18 demonstrate that associative complexes of the polymeric fluorosurfactant are adsorbed onto the surface of the IRE from the compositions of this example, and remain after extensive rinsing with water. In addition, the absolute amount of fluorosurfactant present on the surface is greater than in the case of treatment of the surface without a drying or curing step. Visual examination of the IRE demonstrated that it was rendered hydrophobic by the treatment, as in the other examples herein, and that there was no visible or macroscopic film present. This illustrates an additional method for applying the inventive compositions to surfaces of a substrate to render a treated article exhibiting the desirable surface protective properties provided by the associative complexes.

Example 9

Example 9 are embodiments of associative complex compositions according to the present invention containing a liquid carrier with an organic solvent present.

In these experiments, the inventive formulations were applied directly to the surface of the IRE and left to dry. Naturally, the FT-IR spectrum of the residue on the surface would contain contributions from both residual, but non-substantive components of the formulation, as well as a contribution from the substantive adsorbed polymeric fluorosurfactant. Examination of the raw spectra indicated complete removal of the nonionic surfactant residue with only about 10 rinses. Thus, the surface was rinsed 20 times with deionized water to remove unadsorbed components, and the FT-IR spectrum of the adsorbed layer obtained. In addition, 20 additional rinses, for a total of 40, were then made to demonstrate the substantivity of the adsorbed polymeric fluorosurfactant.

The preceding Examples 1 through 9 herein above demonstrate that the associative complexes of the present invention can be used to significantly increase the surface protective properties of treated surfaces, by using compositions and methods of applications employing the associative complexes. The associative complexes provide surface modification without the need for covalent bond formation between the polymeric fluorosurfactants and the surface, or between the fluorosurfactants and polymer. The associative complexes appear to be robust and their performance properties are maintained and even enhanced with addition of other typical cleaning adjuncts, such as common surfactants, solvents and the like.

The formulation examples given are intended to demonstrate that the modification of surfaces by the adsorption of the associative complexes of polymeric fluorosurfactant and polymer in thin layers, essentially molecular in thickness, can be achieved from aqueous cleaners or treatment compositions. In addition, because of the thermodynamically favored self-assembly of the associative complexes and the favored adsorption onto surfaces, facile modification of surfaces that are submersed in water, such as toilet bowls below the water line, boat hulls, or the plumbing of systems that recirculate significant amounts of water, such as cooling tower heat exchangers or paper-making headboxes can be achieved.

The modification of household surfaces by the associative complexes of the present invention delivers the benefits due to the fluorinated side chains of the polymeric fluorosurfactants, i.e., increased hydrophobicity and oleophobicity. Adhesion of oily soils and subsequent staining by oily soils is reduced by the presence of significant amounts of fluorine-containing groups on the surface.

The effect of the adsorbed associative complexes of the present invention, even if present only as a very thin, essentially molecularly thick layer on surface, can be readily observed by consumers by the changes in the behavior of water and liquid oil drops on a treated surface, in comparison to an untreated surface. A method common in the art to describe these effects in more detail is to measure the contact angle of drops of water and other fluids.

In the examples below, contact angles of glass microscope slides (Fisher Finest premium microscope slides catalog no. 12-544-15, 25×75×1 mm) exposed to various compositions of the present invention are presented. In these experiments, at least two different slides were immersed in the compositions for 2 hours at ambient temperature, to allow adsorption of the polymeric fluorosurfactant. After this exposure, each slide was removed from the composition and immediately rinsed for 30 seconds (each side) with flowing pure water (flow rate approximately 200 ml/minute) from a Barnstead water purification system. In this way, residual unadsorbed components were rapidly removed from the surfaces. The slides were then allowed to dry under ambient conditions. After the rinsing step, all the surfaces of the treated slides were visibly hydrophobic, as in the case of the IREs discussed above. For comparison of an alternative coating application means, the surfaces of one set of three slides were treated by directly applying 50 microliters of the invention composition with a micro syringe, spreading the liquid evenly across the slide with the needle of the syringe, and then allowing the composition to dry in air at room temperature for two hours. After the slides were dry, they were rinsed with pure water as described above to remove excess, unadsorbed components.

After the treated slides were dry, contact angles of high-purity water (from Bamstead system) and hexadecane oil on the slides were measured. A Kruss model DSA 10L instrument was used to capture and store images of the water and oil drops on the treated surfaces. The native software package of this instrument was used to calculate the contact angles of the water and hexadecane, which minimizes operator fatigue and improves the precision of the angles measured. The contact angles included herein are the averages of at least four separate drops placed on the treated slides. In addition, the contact angles of water and hexadecane on multiple untreated slides from the same lot were also measured, and averages calculated. In this way, the significant effects of the modification of the slides by the adsorbed fluorosurfactant can be readily detected. Those skilled in the art will readily interpret the data as indicating that the slides were initially quite hydrophilic, allowing water to achieve very low contact angles. In addition, the contact angle of the hexadecane on the slides was low. Thus, the microscope slides behaved as expected for a clean glass surface of with a relatively high surface energy. Spreading and subsequent adhesion of oily soils, such as hexadecane, on such a surface will thus rapidly occur, "soiling" it.

The contact angle data in Table 20 demonstrate that the associative complexes of the present invention are useful in modifying surfaces to render them hydrophobic, as indicated by the very significant increase in the contact angle of water on the treated surfaces. In addition, the benefit of oleophobicity delivered by the presence of the fluorinated side chains of the polymeric fluorosurfactant is readily apparent by the very significant increase in the contact angle of the hexadecane on the treated surfaces. The modification of these surfaces was achieved, as discussed herein above, without the formation of a macroscopically thick "coating". Even when an inventive compositions was applied directly as a coating by essentially spreading and drying the composition onto the treated surface, results in Table 20 show comparable surface protective properties. Thus, while the inventive compositions may be applied as macroscopic coatings, they do not require this method of application to provide the treated articles with enhanced surface protective properties.

TABLE 19

| | Composition | | | |
|---|---|---|---|---|
| | 28 | 29 | 30 | 31 |
| Ingredients (wt %) | | | | |
| Surfonic L12-8 | 1.93 | 2.30 | 2.00 | 2.00 |
| PAA | — | — | — | 0.01341 |
| PDADMAC | 0.004287 | 0.002452 | 0.005688 | — |
| PolyFox AT-1002 | 0.04214 | 0.018187 | — | — |
| PolyFox 156A | — | — | 0.04870 | — |
| PolyFox AT-1001 | — | — | — | 0.1916 |
| NaOH | — | — | — | 0.00804 |
| DI Water (to 100%) | q.s. | q.s. | q.s. | q.s. |
| Parameters: | | | | |
| R | 0.549 | 0.595 | 0.653 | 1.081 |

TABLE 20

| Treatment | Water Contact Angle (°) (std. deviation) | Hexadecane Contact Angle (°) (std. deviation) | Treatment |
|---|---|---|---|
| Control | 12.7 (0.79) | 7.8 (1.66) | None |
| 28 | 89.6 (0.32) | 50.8 (0.70) | Immersion |
| 29 | 87.6 (2.52) | 48.9 (1.2) | Immersion |
| 30 | 83.4 (2.77) | 30.2 (1.79) | Immersion |
| 31 | 70.6 (2.33) | 51.4 (3.92) | Air dried |

Example 10

Example 10 compositions found in Table 21 are embodiments of Type II associative complexes of the present invention that are formed by combining an anionically charged polymeric fluorosurfactant and a water soluble nonionic polymer (polyethyleneimine), and applied to a substrate in an application process employing a two step process. In the first step, composition 32, containing the water soluble polymer in an acidic aqueous solution, is applied to the surface and allowed to dry. As taught herein above, the surface was then rinsed 10 times, followed by an additional 10 rinses (a total of 20) with deionized water to remove unadsorbed components, and the FT-IR spectrum of the adsorbed layer of nonionic polymer was obtained. In the second step, the surface was exposed to composition 33, containing only the polymeric fluorosurfactant, for 5 minutes. Immediately after this exposure, the composition was removed and the surface rinsed in a similar fashion for a total of 20 rinses with deionized water to remove unadsorbed components. In this example, the formation of an adsorbed complex occurs in situ directly on the treated surface open completion of the second step, without the need for curing or drying in either the first or second step, and further, without the need for exposing the surface to the associative complexes in the first step, due to the thermodynamically favored adsorption described herein above. Such a two-step method for preparing and maintaining a treated surface or article bearing the associative complexes of the present invention may be preferred in some instances, for example, in instances which the sudden increase in hydrophobicity of the surface after the second step provides a visible change in the water repellency of the surface so as to provide a visual performance cue to a consumer as described herein above.

The FT-IR spectrum of the poly(ethyleneimine) polymer used in this example embodiment exhibits absorbance bands due to $CH_2$ groups between about 2830 to 2800 $cm^{-1}$, and between 1470 to 1450 $cm^{-1}$ that can be used to confirm the presence of an adsorbed layer of this polymer formed upon the surface treated in the first step. Inspection of the raw spectra also indicated that the spectrum of this polymer did not contain major absorbance bands that would seriously interfere with measurement of the C—F band of the polymeric fluorosurfactant near 1205 $cm^{-1}$. Thus, the formation of the adsorbed associative complexes on the surface can be monitored using this latter band, and observed band intensities are included in Table 22.

TABLE 21

| | 32 | 33 | C Control |
|---|---|---|---|
| Ingredients (wt %) | | | |
| Surfonic L12-8 | 1.042 | 0 | — |
| Lupasol P | 0.1369 | 0 | — |
| PolyFox AT 1002 | 0 | 0.05 | 1.00 |
| DI Water (to 100%) | q.s. | q.s. | q.s. |
| 1N HCl pH adjustor | q.s. | — | — |
| Parameters: | | | |
| pH | 2.8 | 8.0 | 8.0 |

TABLE 22

| Composition | CH2 Band of Lupasol P Absorbance 2814 $cm^{-1}$ | CH2 Band of Lupasol P Absorbance 1463 $cm^{-1}$ | C—F Absorbance 1205 $cm^{-1}$ | Treatment |
|---|---|---|---|---|
| C (Control) | — | — | 0.001090 | 5 min. exposure, 20x rinse |
| 32 | 0.003831 | 0.001536 | — | Dried, 10x rinse |
| 32 | 0.003251 | 0.001083 | — | Dried, 20x rinse |
| 33 | ND* | ND* | 0.03017 | 5 min. exposure, 10x rinse |
| 33 | ND* | ND* | 0.02749 | 5 min. exposure, 20x rinse |

*Not determinable. Lupasol absorption bands have positive interference from adsorbed layer of fluorosurfactant Results in Table 22 indicate that an adsorbed layer of Lupasol P that is resistant to rinsing is formed in the first step, even in the presence of a surfactant added for this example cleaning composition embodiment. In the second step, the formation of an adsorbed associative complex of the Lupasol P and the polymeric fluorosurfactant results in the delivery of a substantive layer of the associative complex which contains significantly more fluorosurfactant than is adsorbed from the control solution, even though the latter contains a significantly higher concentration of the polymeric fluorosurfactant. Thus, in this embodiment of the present invention, a method for the formation of the Type II associative complexes in situ on a surface, using a nonionic polymer and an anionic polymeric fluorosurfactant is demonstrated. In this embodiment, the versatility of a two step application method using two compositions to form a treated article bearing an associative complex is demonstrated, particularly since the compositions used to treat the surface can differ in pH and the presence of other adjuncts to provide other benefits to the compositions and kits of the present invention, such as for example cleaning, lime scale removal, and the like. Further, even with a two step process to form the associative complexes in situ directly on the treated article, the second step does not require either the first or second partial composition to be dried, cured, or reacted chemically with the surface to effect the desired beneficial surface modification, although drying may optionally be done following either application step, if desired.

Example 11

Example 11 demonstrates how associative complexes of a nonionic water soluble polymer, Lupasol P, and the same anionic polymeric fluorosurfactant used in Example 10 can be delivered onto a surface to effect treatment in an embodiment of the present method employing a single step application process, and also demonstrates the resistance of the associative complex to rinsing.

Results in Table 24 show that the associative complexes of the present invention are readily formed using example composition 34, an embodiment further containing a nonionic surfactant as a cleaning ingredient. The amount of adsorbed polymeric fluorosurfactant delivered to the surface via the absorbed layer of associative complex is significantly larger than that of the control solution, even though the latter contains a higher concentration of polymeric fluorosurfactant. In addition, the adsorbed layer of associative complex is robust to rinsing, as indicated by the fairly minor decrease in the observed Absorbance of the C—F bands, which show less than 17% loss of the available polymeric fluorosurfactant, even after extensive rinsing of the layer (up to 40 rinses) with water.

TABLE 23

| | 34 | C (Control) |
|---|---|---|
| Ingredients (wt %) | | |
| Surfonic L12-8 | 1.041 | — |
| Lupasol P | 0.1369 | — |
| PolyFox AT 1002 | 0.486 | 1.00 |
| DI Water (to 100%) | q.s. | q.s. |
| 1N HCl pH adjustor | q.s | 0 |
| Parameters: | | |
| pH | 2.7 | 8.0 |
| R | 5.69* | — |

*Calculation detail: $C_p = 0.1369$, $C_f = 0.486$ with $F_p$, $Q_p$, $Q_f$ and monomer MW's as provided in Chemical Key. $G_p = 3.184 \times 10^{-3}$, $G_f = 5.593 \times 10^{-4}$ yielding $R = G_p/G_f = 5.69$.

TABLE 24

| Composition | C—F Absorbance 1205 $cm^{-1}$ | % Change C—F Band Absorbance 1205 $cm^{-1}$ | C—F Band Absorbance 1105 $cm^{-1}$ | % Change C—F Band Absorbance, 1105 $cm^{-1}$ | Treatment |
|---|---|---|---|---|---|
| C (Control) | 0.001090 | — | 0.000659 | — | 5 min. exposure, 20x rinse |
| 34 | 0.007485 | Basis | 0.005027 | Basis | Dried, 10x rinse |
| 34 | 0.006850 | −8.48 | 0.004607 | −8.35 | Dried, 20x rinse |
| 34 | 0.006224 | −16.84 | 0.004187 | −16.71 | Dried, 40x rinse |

Example 12

Example 12 demonstrates a further embodiment of the present invention in which associative complexes can be produced from a nonionic water soluble polymer, here the same poly(ethyleneimine) used in Examples 10 and 11, and a nonionic polymeric fluorosurfactant. These example Type II associative complexes are shown to adsorb onto a surface without a drying step, and result in more efficient use of the polymeric fluorosurfactant for surface modification. The nonionic polymeric fluorosurfactant alone shows poor adsorption and poor substantivity on the surface, even when a high concentration of it is employed and even when it is allowed to dry on the surface prior to the rinsing step in an attempt to leave a deposit layered on the surface.

The results in Table 26 show that the associative complexes of the present invention adsorbed onto the surface result in the effective delivery of significant amounts of the nonionic polymeric fluorosurfactant onto the surface despite employing very low fluorosurfactant levels in the treatment compositions. As taught herein above, the thermodynamically favored adsorption of the associative complexes, relative to the small amount of adsorption of the fluorosurfactants alone, is an important factor that can be used to great advantage to modify substrates and articles to produce a surface protective benefit while employing low levels of fluorinated materials.

TABLE 25

| | D (Control) | 35 | 36 | 37 | 38 | 39 |
|---|---|---|---|---|---|---|
| Ingredients, wt % | | | | | | |
| Surfonic L12-8 | — | 1.042 | 1.042 | 1.042 | 1.042 | 1.009 |
| Lupasol P | — | 0.137 | 0.137 | 0.137 | 0.137 | 0.0153 |
| PolyFox 1121 | 20.01 | 0 | 2.86 | 1.137 | 0.610 | 1.007 |

TABLE 25-continued

| | D (Control) | 35 | 36 | 37 | 38 | 39 |
|---|---|---|---|---|---|---|
| Deionized water | q.s. | q.s. | q.s. | q.s. | q.s. | q.s. |
| Parameters: | | | | | | |
| R | — | — | 2.06* | 5.68 | 9.66 | 0.653 |

*Calculation example: $C_p = 0.1369$, $C_f = 2.86$ with $F_p$, $Q_p$, $Q_f$ and monomer MW's as provided in Chemical Key. $G_p = 3.186 \times 10^{-3}$, $G_f = 1.546 \times 10^{-3}$ yielding $R = G_p/G_f = 2.06$.

TABLE 26

| Composition | $CH_2$ Band of Lupasol P Absorbance 1463 $cm^{-1}$ | C—F Absorbance 1205 $cm^{-1}$ | Treatment |
|---|---|---|---|
| D (Control) | — | 0.000657 | Dried on surface, rinsed 10x |
| 35 | 0.000698 | — | Exposed 5 min., rinsed 10x |

TABLE 26-continued

| Composition | $CH_2$ Band of Lupasol P Absorbance 1463 $cm^{-1}$ | C—F Absorbance 1205 $cm^{-1}$ | Treatment |
|---|---|---|---|
| 36 | 0.000767 | 0.000502 | Exposed 5 min., rinsed 10x |
| 37 | 0.000803 | 0.000621 | Exposed 5 min., rinsed 10x |
| 38 | 0.000730 | 0.000421 | Exposed 5 min., rinsed 10x |
| 39 | 0.000392 | 0.000829 | Exposed 5 min., rinsed 10x |

Example 13

Example 13 demonstrates how the associative complexes of the present invention, in a yet another embodiment, can be formed using a nonionic water soluble polymer, here a 1:1 copolymer of vinyl pyrrolidone:vinyl imidiazole (Nonionic Copolymer B), in combination with a nonionic polymeric fluorosurfactant forms a Type II associative complex. The nonionic associative complexes can be formed on the surface via an optional two-step process, or by exposure of the surface to a formulation containing the associative complex, either with or without a drying step employed following surface treatment.

The compositions of these nonionic associative complexes are shown in Table 27 and results of the FT-IR analysis of the surfaces are shown in Table 28. The FT-IR spectrum of the water soluble co-polymer used in this example exhibits an absorbance band due to carbonyl (C═O) groups of the pyrrolidone monomer between about 1685 and 1660 $cm^{-1}$ which can be used to confirm the presence of an adsorbed layer of this polymer. Inspection of the raw spectra also indicated that the spectrum of this copolymer did not contain major absorbance bands that would seriously interfere with the C—F band of the polymeric fluorosurfactant near 1205 $cm^{-1}$. Thus, the formation of the associative complexes absorbed and/or formed upon the surface could be monitored using this band.

TABLE 27

| | D (Control) | 40 | 41 | 42 | 43 | 44 |
|---|---|---|---|---|---|---|
| Ingredients, wt % | | | | | | |
| Surfonic L12-8 | 0 | 1.016 | 0 | 1.042 | 0.1088 | 0.1037 |
| Nonionic Copolymer B | 0 | 0.0605 | 0 | 0.0598 | 0.00647 | 0.00616 |
| PolyFox 1121 | 20.01 | 0 | 1.78 | 4.93 | 0.0462 | 0.1014 |
| Deionized water | q.s. | q.s. | q.s. | q.s. | q.s. | q.s. |
| Parameters: | | | | | | |
| R | — | — | — | 0.101* | 1.16 | 0.101 |

*Calculation example: $C_p = 0.0598$, $C_f = 4.93$ with $F_p$, $Q_p$, $Q_f$ and monomer MW's as provided in Chemical Key. $G_p = 2.694 \times 10^{-4}$, $G_f = 2.665 \times 10^{-3}$ yielding $R = G_p/G_f = 0.101$.

TABLE 28

| Composition | C═O Absorbance 1680 $cm^{-1}$ | C—F Absorbance 1205 $cm^{-1}$ | Treatment |
|---|---|---|---|
| D (Control) | — | 0.000657 | Dried on surface, rinsed 10x |
| 40 | 0.002290 | — | Step1 - Exposed 5 min. Then 10x rinse |
| 40 | 0.002058 | — | Step 1 - 20x rinse |
| 41 | 0.002254 | 0.000992 | Step 2 - Exposed 5 min. Then 10x rinse |
| 42 | 0.003077 | 0.000657 | Exposed 5 minutes, 10x rinse |
| 42 | 0.003359 | 0.001099 | Second application, exposed 5 minutes, 10x rinse |
| 43 | 0.004191 | 0.001570 | Dried on surface, rinsed 10x |
| 44 | 0.004750 | 0.001778 | Dried on surface, rinsed 10x |

Table 28 demonstrates that nonionic associative complexes of the present invention can be delivered in a two step application process. Exposure of the surface to composition 40 results in the adsorption of a substantive layer of the water soluble copolymer (without a drying step) that resists 20 rinses with water. In step 2, the associative complexes are formed in situ by exposing the adsorbed layer of the nonionic copolymer to composition 41, comprising only the polymeric fluoro-surfactant component in water for 5 minutes, followed by rinsing. This method of treating the surface results in more adsorbed polymeric fluorosurfactant on the surface than can be achieved by drying Control composition D, which contains a much higher concentration of the polymeric fluorosurfactant alone.

Table 28 also shows that the nonionic associative complexes can be absorbed from an embodiment formulation (composition 42) after a simple 5 minute exposure, without employing a drying step. In addition, as taught herein above, a second application of the same composition to the surface results in a slight increase in the amount of adsorbed associative complex, even though the composition also contains a normal surfactant for cleaning purposes, because of the thermodynamically favored adsorption of the thin layer of adsorbed associative complex onto treated surfaces bearing an existing layer of associative complex as well. Thus, multiple applications of formulations containing the associative complexes of the present invention can be employed in a method for renewing the surface modification benefits delivered by the adsorbed layers of the associative complexes, even in embodiments in which optional performance adjuncts are included to provide other benefits, such as illustrated in this example, with a surfactant included in the formulation for cleaning efficacy.

Table 28 also shows that the associative complexes of the present invention can be adsorbed on a surface from treatments (compositions 42 and 43) having much lower total actives concentration by allowing the compositions to dry on the surface, followed by rinsing with water to remove unadsorbed components.

Example 14

Example 14 shows an embodiment in which associative complexes of the present invention can be formed by employing a water soluble nonionic copolymer (1:1 copolymer of vinyl pyrrolidone:vinyl imidazol) and an anionic polymeric fluorosurfactant, in formulations shown in Table 29. As taught herein above, the carbonyl band absorbance can be used to monitor the presence of the nonionic copolymer on the surface, and the C—F band can be used to monitor the polymeric fluorosurfactant on the surface.

The results of the FT-IR analysis of the surfaces are shown in Table 30 and reveal that the associative complexes adsorb onto the surface, and are substantive through 10 and 20 rinses with deionized water. The adsorbed associative complexes are formed without the need for a drying or curing step. As taught herein above, delivering fluorosurfactant to the surface using the thermodynamically favored adsorption of the associative complexes makes more efficient use of the fluorosurfactant in the composition, as can be seen by the comparison with the fluorosurfactant control results.

TABLE 29

| Ingredients, wt % | C (Control) | 45 | 46 |
|---|---|---|---|
| Surfonic L12-8 | — | 0.1047 | 0.1017 |
| Nonionic copolymer B | — | 0.00622 | 0.00605 |
| PolyFox AT1002 | 1.00 | 0.0267 | 0.0156 |
| Deionized water | q.s. | q.s. | q.s. |
| Parameters | | | |
| R* | — | 0.965 | 1.52 |
| pH | 8.0 | 7.4 | 7.4 |

*R mole ratio based on vinyl pyrrolidone monomer content in polymer.

TABLE 30

| Composition | C=O Absorbance 1680 $cm^{-1}$ | C—F Absorbance 1205 $cm^{-1}$ | Treatment |
|---|---|---|---|
| C (control) | — | 0.001090 | 5 min. exposure, 20x rinse |
| 45 | 0.001175 | 0.003472 | 5 min. exposure, 10x rinse |
| 45 | 0.001116 | 0.002689 | 20x rinse |
| 46 | 0.003130 | 0.009378 | 5 min exposure, 10x rinse |
| 46 | 0.002798 | 0.007994 | 20x rinse |

The foregoing has described the principles, illustrative embodiments, and modes of operation of the present invention. However, the invention should not be construed as limited to the particular embodiments discussed. Instead, the above described embodiments should be regarded as illustrative rather than restrictive, and it should be appreciated that variations may be made in those embodiments by workers skilled in the art without departing from the scope of the present invention as defined by the following claims.

We claim:

1. A composition comprising:

a. an associative complex comprising:

i. a water soluble and/or water dispersible polymer;

ii. at least one polymeric fluorosurfactant capable of forming an associative complex with said polymer, wherein said polymeric fluorosurfactant comprises a fluorosurfactant derived from polymerization of a fluorinated oxetane;

b. optionally, a dispersant, and;

c. optionally, a liquid carrier, wherein the associative complex forms an invisible film upon a surface of a substrate wherein said film is less than 500 nanometers in average thickness;

wherein the associative complex molar ratio parameter, R, is greater than 0 to about 20, and wherein said associative complex is selected from the group consisting of I) (A) said polymer comprising a polar and/or polarizable first constituent capable of forming a hydrogen bond; and (B) said polymeric fluorosurfactant comprising a polar and/or polarizable second constituent capable of forming a hydrogen bond with said first constituent; and II) (A) said polymer comprising a charged and/or polarizable third constituent and at least one polar and/or polarizable fourth constituent capable of forming a hydrogen bond; and (B) said polymeric fluorosurfactant comprising a charged/and or polarizable fifth constituent and at least one polar and/or polarizable sixth constitutuent capable of forming a hydrogen bond with said fourth constituent; wherein said fifth constituent bears a charge opposite to that of said third constituent.

2. The composition of claim 1 wherein said polymer is selected from the group consisting of amphoteric polymers, neutral polymers, zwitterionic polymers, polymers having at least one polar monomer subunit capable of forming a hydrogen bond, and mixtures thereof.

3. The composition of claim 1 wherein said polymeric fluorosurfactant is selected from the group consisting of anionic, amphoteric, cationic, and/or ionizable polymeric fluorosurfactants, and mixtures thereof.

4. The composition of claim 1 wherein said polymer comprises a water soluble and/or water dispersible amphoteric polyelectrolyte having at least two monomer subunits independently selected from the group consisting of:

(i) a monomer having a permanent cationic charge or that is capable of forming a cationic charge on protonation;

(ii) a monomer having a permanent anionic charge or that is capable of forming an anionic charge on either deprotonation and/or ionization; and (iii) a zwitterionic monomer capable of forming an electrostatic bond with either a permanently charged anionic or cationic fluorosurfactant;

(iv) a monomer that has an uncharged hydrophilic group; and (v) a monomer that is hydrophobic; and/or combinations thereof.

5. The composition of claim 1 wherein said polymeric fluorosurfactant is selected from the group consisting of polyfluorooxetanes, polyfluorooxetane-polyether copolymers, grafted polyfluorooxetane-polysiloxane copolymers, their salt forms and/or derivatives, and/or mixtures thereof.

6. The composition of claim 1 wherein said polymeric fluorosurfactant comprises a partially fluorinated polymeric surfactant.

7. The composition of claim 1 wherein said polymeric fluorosurfactant contains at least one polar substituent selected from the group consisting of sulfate, sulfonate, carboxylate, phosphate, phosphonate, nitrate and/or mixtures thereof.

8. The composition of claim 6 wherein said partially fluorinated polymeric fluorosurfactant comprises at least one periluorinated alkyl substituent comprising 1 to 20 carbon atoms.

9. The composition of claim 6 wherein said partially fluorinated polymeric fluorosurfactant comprises at least one periluorinated alkyl substituent comprising 1 to 7 carbon atoms.

10. The composition of claim 6 wherein said partially fluorinated polymeric fluorosurfactant comprises at least one periluorinated alkyl substituent comprising 1 to 4 carbon atoms.

11. A method for preparing a treated article comprising the steps of:

1. providing a substrate; and
2. applying to at least one surface of said substrate a treatment composition that comprises:
   (a) an associative complex comprising:
      i. a water soluble and/or water dispersible polymer;
      ii. at least one polymeric fluorosurfactant wherein said polymeric fluorosurfactant comprises a fluorosurfactant derived from polymerization of a fluorinated oxetane and is selected from the group consisting of neutral, anionic, cationic, zwitterionic and/or ionizable fluorinated polymeric surfactants, and/or mixtures thereof, wherein said fluorosurfactant forms an associative complex with said polymer;
   (b) optionally, a dispersant, and;
   (c) optionally, a liquid carrier; and
3. removing said treatment composition from said substrate to leave a treated article whereby said associative complex is deposited on said surface of said substrate;

wherein the associative complex forms an invisible film upon said surface of said substrate wherein said film is less than 500 nanometers in average thickness;

wherein the associative complex molar ratio parameter, R, is greater than 0 to about 20.0; and wherein said associative complex is selected from the group consisting of I) (A) said polymer comprising a polar and/or polarizable first constituent capable of forming a hydrogen bond; and
   (B) said polymeric fluorosurfactant comprising a polar and/or polarizable second constituent capable of forming a hydrogen bond with said first constituent; and II) (A) said polymer comprising a charged and/or polarizable third constituent and at least one polar and/or polarizable fourth constituent capable of forming a hydrogen bond; and
   (B) said polymeric fluorosurfactant comprising a charged/and or polarizable fifth constituent and at least one polar and/or polarizable sixth constitutuent capable of forming a hydrogen bond with said fourth constituent; wherein said fifth constituent bears a charge opposite to that of said third constituent.

12. The method of claim 11 wherein said substrate is selected from the group consisting of a hard surface, porous surface, woven substrate, non-woven substrate, particulate material, and/or combinations thereof.

13. The method of claim 12 wherein said hard surface is selected from the group consisting of glass, porcelain, glazed ceramic, metal, laminate, polymeric substrate, semiconductor, silicon, germanium, gallium arsenide, and/or combinations thereof.

14. The method of claim 12 wherein said hard surface comprises an object of construction selected from the group consisting of an airplane, automobile, bathtub, boat, building, ceiling, floor, electronic semiconductor substrate, fluid distributing system, household appliance, household fixture, micro fluidic device, shower, sink, ship, toilet, vehicle, wall, water distribution system, water recirculation system, window, and/or combinations thereof.

15. The method of claim 12 wherein said particulate material is selected from the group consisting of inorganic oxide, metallic oxide, semiconductor oxide, clay, silica, silica gel, zeolite, and/or combinations thereof, wherein said particulate material is in the form of a plurality of particles, wherein said particles have cross sectional dimensions of between 1 nanometer to 1000 microns.

16. The method of claim 11 wherein said article is provided with at least one increased surface protective property selected from the group consisting of easier cleaning, stays cleaner longer, easier next time cleaning, improved cleaning, faster cleaning, improved and/or extended protection, dirt repellency, soil repellency, microorganism repellency, reduced biofouling, reduced germ build-up, scale prevention, reduced soap scum deposition, reduced soiling, reduced cleaning time, and/or combinations thereof.

17. The method of claim 11 wherein said treatment composition is present on a pre-moistened absorbent wiping article selected from the group consisting of wipe, foam, sponge, pad, absorbent pillow, non-woven article, and combinations thereof, and wherein said container is selected from the group consisting of a wipes canister, single use wipe package, wipes refill package, water soluble container, water soluble overpackage, and/or combinations thereof.

18. The composition of claim 1 wherein said polymeric fluorosurfactant is selected from molecules corresponding to any one of structures I-V:

I

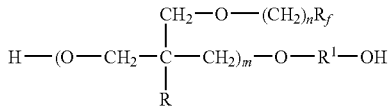

II

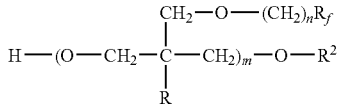

III

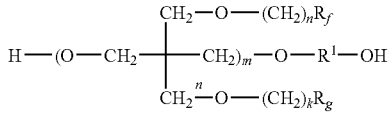

IV

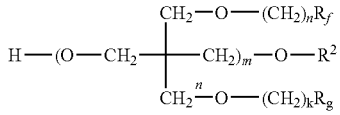

V

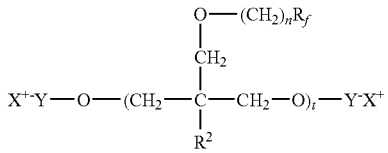

wherein m>1 to about 100, n=1 to about 50, k=1 to about 50 including n=k, t=1 to about 100, wherein Rf and Rg are independently selected from the group consisting of —$CF_3$, —$CF_2CF_3$, —$(CF_2)_pCF_3$, —R'$CF_3$, —R'$(CF_3)_p$, —R"$(CF_3)_q$, perfluorinated alkyl radical, perfluorinated aryl radical, partially fluorinated alkyl radical, partially fluorinated aryl radical, derivatives thereof, and/or combinations thereof, wherein R' is a C1 to C20 linear or branched, alkyl or alkylene moiety, optionally substituted with and/or terminated with at least one —$CF_3$ group, R" is radical comprising a benzyl, phenyl and/or aryl group with q degrees of —$CF_3$ substitution, wherein p is 1 to about 10, wherein q is between 1 and 5, wherein R is hydrogen, or an alkyl comprising from 1 to 6 carbon atoms, R1 is an alkyl having from 1 to 18 carbon atoms, R2 is an alkyl having from 1 to 40 carbon atoms, wherein R, R1 and/or R2 may be alkyl and/or alkylene moieties derivatized with radicals comprising carboxylic, ester, amine, amide, aminoamide, siloxane, silyl, alkylsiloxane, perfluoroalkyl and/or combinations thereof, wherein $X^+$ is a cationic counterion, and wherein $Y^-$ is an anionic moiety selected from the group consisting of carbonate, borate, sulfate, sulfonate, phosphate, phosphonate, nitrate and/or combinations thereof.

19. The composition of claim 18, wherein said polymeric fluorosurfactant is selected from molecules corresponding to any one of said structures I-V, wherein Rf and Rg are independently selected from the group consisting of $—CF_3$, $—CF_2CF_3$, $—(CF2)_pCF_3$, $—R'CF_3$, $—R'(CF_3)_p$, $—R''(CF_3)_q$, and/or combinations thereof, wherein R' is a C1 to C20 linear or branched, alkyl or alkylene moiety, optionally substituted with and/or terminated with at least one $—CF_3$ group, wherein R" is radical comprising a benzyl, phenyl and/or aryl group with q degrees of $—CF_3$ substitution, wherein p is 1 to about 10, wherein q is between 1 and 5, and wherein t is between 1 and 10.

20. The composition of claim 1, wherein said water soluble and/or water dispersible polymer comprises an anionic polymer having at least one monomer having a permanent anionic charge or that is capable of forming an anionic charge on either deprotonation and/or ionization that is selected from the group consisting of acrylic acid, methacrylic acid, maleic anhydride, maleic acid, succinic anhydride, vinylsulfonate, styrene sulfonic acid, sulfoethylacrylate, itaconic acid, acrylamide methyl propanesulfonic acid, 2-(sulfooxy)ethyl methacrylate ammoniate, 2-hydroxyethylmethacrylate, acrylic acid, methacrylic acid, ethacrylic acid, dimethylacrylic acid, maleic anhydride, succinic anhydride, vinylsulfonate, cyanoacrylic acid, methylenemalonic acid, vinylacetic acid, allylacetic acid, ethylidineacetic acid, propylidineacetic acid, crotonic acid, fumaric acid, itaconic acid, sorbic acid, angelic acid, cinnamic acid, styrylacrylic acid, citraconic acid, glutaconic acid, aconitic acid, phenylacrylic acid, acryloxypropionic acid, citraconic acid, vinylbenzoic acid, N-vinylsuccinamidic acid, mesaconic acid, methacroylalanine, acryloylhydroxyglycine, sulfoethyl methacrylate, sulfopropyl acrylate, sulfoethyl acrylate, styrene sulfonic acid, 2-methacryloyloxymethane-1-sulfonic acid, 3-methacryloyloxypropane-1-sulfonic acid, 3-(vinyloxy)propane-1-sulfonic acid, ethylenesulfonic acid, vinyl sulfuric acid, 4-vinylphenyl sulfuric acid, ethylene phosphonic acid, vinyl phosphoric acid, and/or combinations thereof.

* * * * *